US008077118B2

(12) United States Patent
Ogura

(10) Patent No.: US 8,077,118 B2
(45) Date of Patent: Dec. 13, 2011

(54) DISPLAY APPARATUS AND DRIVING METHOD THEREOF

(75) Inventor: Jun Ogura, Fussa (JP)

(73) Assignee: Casio Computer Co., Ltd., Tokyo (JP)

( * ) Notice: Subject to any disclaimer, the term of this patent is extended or adjusted under 35 U.S.C. 154(b) by 450 days.

(21) Appl. No.: 12/411,534

(22) Filed: Mar. 26, 2009

(65) Prior Publication Data

US 2009/0244110 A1 Oct. 1, 2009

(30) Foreign Application Priority Data

Mar. 28, 2008 (JP) ..... 2008-087933
Mar. 28, 2008 (JP) ..... 2008-088680

(51) Int. Cl.
*G09G 3/18* (2006.01)

(52) U.S. Cl. ..... 345/52; 345/45

(58) Field of Classification Search ..... 345/45–52, 345/690

See application file for complete search history.

(56) References Cited

U.S. PATENT DOCUMENTS

| | | | | |
|---|---|---|---|---|
| 7,280,104 | B2 * | 10/2007 | Morita et al. | 345/211 |
| 7,355,459 | B2 * | 4/2008 | Miyazawa | 327/112 |
| 7,876,302 | B2 * | 1/2011 | Aoki | 345/100 |
| 2004/0135569 | A1 * | 7/2004 | Yun | 323/355 |
| 2005/0017965 | A1 * | 1/2005 | Morita et al. | 345/211 |
| 2008/0174527 | A1 * | 7/2008 | Hattori | 345/76 |
| 2010/0277449 | A1 * | 11/2010 | Kanda | 345/206 |

FOREIGN PATENT DOCUMENTS

| | | | |
|---|---|---|---|
| JP | 2002-091378 | A | 3/2002 |
| JP | 2002-156923 | A | 5/2002 |
| JP | 2003-280584 | A | 10/2003 |
| JP | 2009-244342 | A | 10/2009 |
| JP | 2009-244411 | A | 10/2009 |

OTHER PUBLICATIONS

Japanese Office Action dated Apr. 13, 2010 and English translation thereof in counterpart Japanese Application No. 2008-087933.
Japanese Office Action dated Apr. 13, 2010 and English translation thereof in counterpart Japanese Application No. 2008-088680.

* cited by examiner

*Primary Examiner* — Nitin Patel
(74) *Attorney, Agent, or Firm* — Holtz, Holtz, Goodman & Chick, PC

(57) ABSTRACT

A display apparatus for displaying image information according to display data, including: display pixels, each having a light emitting element; and a drive circuit for making each of the light emitting elements emit a light having brightness according to the display data, wherein the drive circuit includes: a plurality of power source circuits each generating a first voltage used as a light emission drive voltage to be supplied to the display pixels to flow a drive current according to the display data to each of the light emitting elements, wherein the power source circuits generates voltages of different values, respectively, as the first voltage; and a selecting circuit for switching the plurality of power source circuits so that any one of the power source circuits is selected according to a display state set to the display pixels and for causing the selected power source circuit to generate the first voltage.

20 Claims, 7 Drawing Sheets

DISPLAY APPARATUS AND DRIVING METHOD THEREOF

BACKGROUND OF THE INVENTION

1. Field of the Invention

The present invention relates to a display apparatus using a light emitting element in a display pixel, and more particularly to a display apparatus using an organic electroluminescence (EL) element as the light emitting element.

2. Related Art

The organic EL element, which is the light emitting element, takes a laminated structure of laminating in order of an anode, an EL layer and a cathode, on a substrate. When a voltage is applied between the anode and the cathode, holes and electrons are injected into the EL layer, and the EL layer performs electroluminescence. An EL element designed to perform a display by the transmission of the substrate, on which the organic EL element is provided, of a light produced by the light emission of the EL layer is called as a bottom emission type EL element. On the other hand, an EL element designed to perform a display by the light emission to the outside from the opposite side of the substrate, on which the organic EL element is provided, is called as a top emission type EL element.

On the other hand, organic EL displays to use the organic EL elements are roughly classified into passive drive system organic EL displays and active matrix drive system organic EL displays. The active matrix drive system organic EL displays severally have extremely superior display characteristics, such as very high contrast, a wide view angle characteristic, and a superior moving image characteristic.

Moreover, also as for power consumption, the organic EL display is a self light emitting device, and can achieve the reduction of power consumption thereof by controlling the displaying and lighting rate (average picture level) thereof. Furthermore, if the processing of changing the brightness of maximum gradation, for example, between the time of using the organic EL display and the time of waiting the use thereof (automatic brightness control (ABC)) is performed by providing a dimmer function (automatic light control function), then the electric power to be consumed for the light emission of the organic EL element can be suppressed.

The active matrix drive system organic EL display is provided with one or a plurality of thin film transistors per pixel, and the organic EL display makes the organic EL element emit a light by means of the thin film transistors. For example, the display is provided with two thin film transistors per pixel, wherein the thin film transistors include a drive transistor for flowing a current through the organic EL element by receiving the application of a signal voltage according to display data at the gate electrode of the drive transistor and a selection transistor for performing switching for supplying the signal voltage according to the display data to the gate electrode of the drive transistor.

Now, the current to make the organic EL element emit a light has a difference in, for example, two or more digits between the current value necessary for a time when each of the pixels of the organic EL display emits lights at a maximum brightness when in a high brightness display mode and the current value necessary for a time when in a low brightness display mode at a dimmer time. Consequently, if a drive circuit that generates a power source voltage or the like to be supplied to the pixels is designed to generate a voltage necessary for the time of the high brightness display mode, then the power consumption of the drive circuit at a low brightness display mode at a dimmer time may not be reduced sufficiently. Particularly, in the case of an application in which the use of the drive circuit on the low brightness at a dimmer time is a normal state, power consumption at a dimmer time should be reduced.

SUMMARY OF THE INVENTION

The present invention is directed to provide a display apparatus having a high brightness display mode and a low brightness display mode as a display state, and capable of being compatible with the high brightness display mode and low power consumption at a time of the low brightness display mode.

According to a first aspect of the present invention, there is provided a display apparatus for displaying image information according to display data, the apparatus includes: display pixels, each having a light emitting element; and a drive circuit for making each of the light emitting elements emit a light having brightness according to the display data, and including a plurality of power source circuits and a selecting circuit, wherein each of the plurality of power source circuits generates a first voltage used as a light emission drive voltage to be supplied to the display pixels to flow a drive current according to the display data to each of the light emitting elements and generates voltages of different values, respectively, as the first voltage; and the selecting circuit selects any one of the plurality of power source circuits according to a display state set to the display pixels and causes the selected power source circuit to generate the first voltage.

According to a second aspect of the present invention, there is provided a display apparatus for displaying image information corresponding to display data, the apparatus includes: display pixels, each having a light emitting element; and a drive circuit for making each of the light emitting elements emit a light having brightness according to the display data, and including a plurality of power source circuits and a selecting circuit, wherein each of the plurality of power source circuits generates a first voltage used as a light emission drive voltage to be supplied to the display pixels to flow a drive current according to the display data to each of the light emitting elements and a second voltage to set a signal level of a control signal to perform drive control of each of the display pixels and generates voltages of different values as the first voltage and different values as the second voltage, respectively; and the selecting circuit selects any one of the plurality of power source circuits according to a display state set to the display pixels and causes the selected power source circuit to generate the first voltage and the second voltage.

According to a third aspect of the present invention, there is provided a drive method of a display apparatus for displaying image information according to display data by display pixels, each having a light emitting element, wherein the display apparatus comprising a plurality of power source circuits, each generating a first voltage used as a light emission drive voltage to be supplied to the display pixels and respectively generating voltages of different values as the first voltage; and the drive method comprises the steps of: selecting any one of the plurality of power source circuits according to a display state set to the plurality of display pixels; causing the selected power source circuit to generate the first voltage; and causing the other power source circuit not to generate the first voltage.

According to a fourth aspect of the present invention, there is provided a drive method of a display apparatus for displaying image information according to display data by display pixels, each having a light emitting element, wherein the display apparatus comprising a plurality of power source circuits, each generating a first voltage used as a light emission drive voltage to be supplied to each of the display pixels and a second voltage used for setting signal level of a control signal for drive controlling the display pixels and respectively generating voltages of different values as the first voltage and the second voltage; and the drive method comprises the steps of: selecting any one of the plurality of power source circuits according to a display state set to the plurality of display pixels; causing the selected power source circuit to generate the first voltage and the second voltage; and causing the other power source circuit not to generate the first voltage and the second voltage.

DETAILED DESCRIPTION OF THE PREFERRED EMBODIMENTS

In the following, the display apparatus and the drive method thereof according to an embodiment of the present invention will be described with reference to the attached drawings. Although, technically preferable various limitations for implementing the present invention are put on the embodiment described below, the scope of the present invention is not limited to the following embodiment and the shown examples.

First Embodiment

First of all, a display apparatus according to a first embodiment of the present invention will be described with reference to the drawings.

Figure 1:
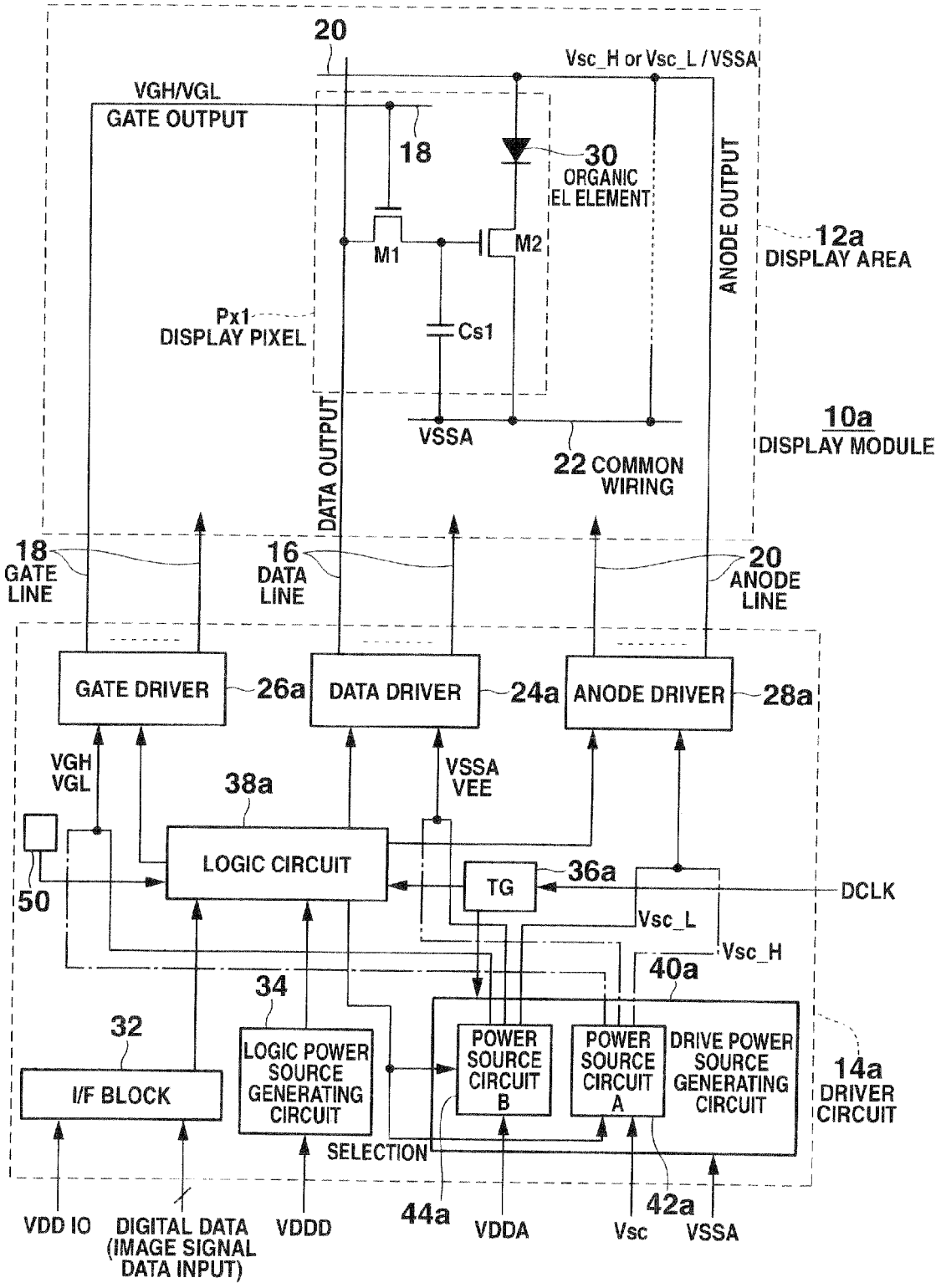
FIG. 1 is a diagram showing the schematic configuration of an active matrix drive system display module according to a first embodiment of the present invention.

FIG. 1 is a diagram showing the schematic configuration of an active matrix drive system display module 10*a* according to the first embodiment of the present invention.

The display module (display apparatus) 10*a* of the first embodiment includes a display area 12*a*, in which a plurality of pixels is arranged in a matrix, and a driver circuit (driving circuit) 14*a* disposed in the neighborhood of the display area 12*a*.

The display area 12*a* includes n (a plurality of) data lines 16 arranged to be in parallel with one another, m (a plurality of) gate liens 18 arranged so as to be perpendicular to the data lines 16 and to be in parallel with one another, m (a plurality of) anode lines 20 arranged between each of the gate lines 18 and to be in parallel with the gate lines 18, a plurality of (m×n) display pixels Px1 arranged along the data lines 16 and the gate liens 18 to be in a matrix, and a common wiring 22, to which a predetermined electric potential (for example, the analog ground voltage VSSA) is applied. Incidentally, m and n severally indicates a natural number of two or more.

A drive voltage V, which is a signal voltage having a voltage value according to display data, is applied from a data driver (data drive circuit) 24*a* of the driver circuit 14*a* to each of the data lines 16. Moreover, a gate output, which is a scanning voltage having the electric potentials of the high level thereof as a gate selection voltage VGH and the low level thereof as a gate non-selection voltage VGL, is applied from a gate driver (scan drive circuit) 26*a* of the driver circuit 14*a* to each of the gate lines 18. Then, an anode output having the electric potentials of the high level thereof as a light emission drive voltage Vsc_L or Vsc_H and the low level thereof as, for example, the analog ground voltage VSSA is applied from an anode driver (power source drive circuit) 28*a* of the driver circuit 14*a* to each of the anode lines 20. Incidentally, the light emission drive voltage Vsc_L or Vsc_H will be described later.

Any of the display pixels Px1 is configured to be the same, and accordingly one configuration of them is representatively shown in FIG. 1.

The display pixel Px1 includes an organic EL element 30 as a light emitting element and a pixel drive circuit, disposed in the neighborhood of the organic EL element 30, equipped with, for example, two N channel type amorphous silicon thin film transistors (Hereinafter simply referred to as transistors) M1 and M2, and a capacitor Cs1. In the following, the transistors M1 and M2 will be referred to as a selection transistor M1, a drive transistor M2. Moreover, the capacitor Cs1 will be referred to as a holding capacitor Cs1.

A source electrode of the selection transistor M1 is connected to the data line 16; a drain electrode of the selection transistor M1 is connected to a gate electrode of the drive transistor M2 and one electrode of the holding capacitor Cs1; and a gate electrode of the selection transistor M1 is connected to the gate line 18.

A drain electrode of the drive transistor M2 is connected to a cathode electrode of the organic EL element 30; the gate electrode of the drive transistor M2 is connected to the one electrode of the holding capacitor Cs1; and a source electrode of the drive transistor M2 is connected to the common wiring 22.

The cathode electrode of the organic EL element 30 is connected to the drain electrode of the drive transistor M2, and an anode electrode of the organic EL element 30 is connected to the anode line 20.

On the other hand, the driver circuit 14*a* includes an interface (hereinafter simply referred to as I/F) block 32, a logic power source generating circuit 34, a timing generator (hereinafter simply referred to as TG) 36*a*, a logic circuit 38*a*, a drive power source generating circuit 40*a*, and an illuminance sensor 50 in addition to the data driver 24*a*, the gate driver 26*a*, and the anode driver 28*a*, mentioned above.

The I/F block 32 operates by an interface power source VDDIO supplied from the outside and receives an image signal data input, a control command, and the like, transmitted from the outside as digital data to supply the received signals to the logic circuit 38*a*. The logic power source generating circuit 34 generates a logic voltage for operating the logic circuit 38*a* on the basis of a logic power source voltage VDDD supplied from the outside. The TG 36*a* controls the operation timing of the logic circuit 38*a* and the drive power source generating circuit 40*a* on the basis of a dot clock DCLK supplied from the outside.

The logic circuit 38*a* performs the control of the data driver 24*a*, the gate driver 26*a*, and the anode driver 28*a* in accordance with digital data from the I/F block 32.

That is, the gate driver 26*a* is a scanning and driving unit, to set each of the display pixels Px1 in each row to the selection state thereof in order by applying a scanning signal voltage (gate output) to each of the gate lines 18 in the display area 12*a* in order by the use of the gate selection voltage VGH and the gate non-selection voltage VGL, generated in the drive power source generating circuit 40*a*. The logic circuit 38*a* controls the scanning timing of the gate driver 26*a*.

Moreover, the data driver 24*a* is a signal drive unit to generate a drive voltage having a voltage value according to display data, and supplies the generated drive voltage through the data lines 16 to each of the display pixels Px1 in a row in the display area 12*a* set to the selection state thereof by the gate driver 26*a* by the use of a data driver drive power source voltage VEE generated by the drive power source generating circuit 40*a*. The logic circuit 38*a* generates the display data on the basis of an image signal data input from the outside. Incidentally, the data driver 24*a* includes, for example, a digital to analog (D/A) converter for generating the drive voltage according to the gradation value of a display signal on the basis of a plurality of gradation voltages set in advance, a γ circuit to suitably set the value of each gradation of a gradation voltage (called as a γ characteristic). The plurality of gradation voltages is generated on the basis of the data driver drive power source voltage VEE from the drive power source generating circuit 40*a*.

The anode driver 28*a* applies an anode output to the anode line 20 by the use of the light emission drive voltages Vsc_L and Vsc_H generated by the drive power source generating circuit 40*a*, and the logic circuit 38*a* controls the application timing thereof.

The drive power source generating circuit 40*a* generates various voltages to be supplied to the respective sections of the display module 10*a* on the basis of the analog power sources Vsc and VDDA supplied from the outside. That is, the drive power source generating circuit 40*a* generates the data driver drive power source voltages VEE to be supplied to the data driver 24*a*, the gate selection voltage VGH and the gate non-selection voltage VGL to be supplied to the gate driver 26*a*, the light emission drive voltages Vsc_L and Vsc_H to be supplied to the anode driver 28*a*, and the like.

The display module 10*a* having the configuration described above is configured to perform the light emission control of the organic EL element 30 as shown in the following by performing on-off control of the two transistors M1 and M2 of the pixel drive circuit in each of the display pixels Px1 in the display area 12*a*.

In the selection period of a display pixel Px1, a gate output of the high level (gate selection voltage VGH) is applied to the gate line 18 in a specified row from the gate driver 26*a* of the driver circuit 14*a*, and a high level light emission drive voltage Vsc_L or Vsc_H is applied to the anode line 20 of the row from the anode driver 28*a* of the driver circuit 14*a*. Moreover, a drive voltage having a voltage value corresponding to the brightness gradation of the display data corresponding to each of the display pixels Px1 in the row, which is taken in by the data driver 24*a*, is supplied to each of the data lines 16 in synchronization with the timing.

Hereby, the selection transistor M1 constituting the pixel drive circuit of the display pixel Px1 performs turning-on operation. Then, the drive voltage is applied to the gate electrode of the drive transistor M2 and the one electrode of the holding capacitor Cs1 through the data line 16. Hereby, an electric charge corresponding to a voltage Vgs between the gate and the source of the drive transistor M2 corresponding to an electrical potential difference between the drive voltage and an electrical potential of the common wiring 22 (for example, the analog ground voltage VSSA) is charged (written) to the holding capacitor Cs1 to be held (charged) as a voltage component. Then, the drive transistor M2 performs turning-on operation because the voltage Vgs between the gate and the source of the drive transistor M2 is equalized with a voltage between both sides of the holding capacitor Cs1, and a current (drain-source current Ids: drive current) corresponding to a drain-source voltage Vds and the voltage Vgs between the gate and the source of the driving transistor M2 is flown between the drain and the source of the driving transistor M2 from the anode line 20 through the organic EL element 30. The organic EL element 30 emits light according to the drive current.

Subsequently, in the non-selection period of the display pixel Px1, a gate output of low level (gate non-selection voltage VGL) is applied to the gate line 18 in a particular row from the gate driver 26 of the driver circuit 14, and the selection transistor M1, which constitutes a pixel drive circuit, performs turning-off operation. The holding capacitor Cs1 holds the electric charge held in the selection period described above. Then, the on operation of the drive transistor M2 is continued, the drive current is continuously flown between the source and the drain of the drive transistor M2, and the light emitting operation of the organic EL element 30 is continued.

Consequently, the drive current is continuously supplied to the organic EL element 30 through the drive transistor M2 according to a voltage value of the drive current corresponding to the brightness gradation of the written display data, and the organic EL element 30 continues the light emitting operation in the brightness gradation corresponding to the display data.

Then, by executing the series of operations described above to the display pixels Px1 in all of the rows constituting the display area 12*a* repeatedly, each of the display pixels Px1 in the display area 12*a* emits a light in the brightness gradation according to the display data, and consequently desired image information is displayed.

Then, in the first embodiment, the drive power source generating circuit 40*a* is equipped with two kinds of power source circuits of a power source circuit A (first power source circuit) 42*a* and a power source circuit B (second power source circuit) 44*a*. Here, the power source circuit A 42*a* is a power source circuit to function at the time when the maximum brightness set to the organic EL elements 30 of the display pixels Px1 is relatively high and the output currents are large at the time of the maximum gradation of display data, and generates the data driver drive power source voltage VEE, the gate selection voltage VGH, the gate non-selection voltage VGL, and the light emission drive voltage Vsc_H (first voltage), and the like, for a high brightness display on the basis of the analog power source Vsc with high efficiency. Moreover, the power source circuit B 44*a* is a power source circuit to function at the time when the maximum brightness set to the organic EL elements 30 of the display pixels Px1 is relatively low and the output current value is small at the time of the maximum gradation of display data, and generates the data driver drive power source voltage VEE, the gate selection voltage VGH, the gate non-selection voltage VGL, and the light emission drive voltage Vsc_L (first voltage), and the like, for a low brightness display on the basis of the analog power source VDDA. Here, electric potential of the analog power sources Vsc, the light emission drive voltage Vsc_H for the high brightness display, light emission drive voltage Vsc_L for the low brightness display and the analog power source VDDA are in a relation of: Vsc≧Vsc_H>Vsc_L≧VDDA. The electric potential of the analog power source VDDA is set to be lower than that of the analog power source Vsc, and the electric potential of the light emission drive voltage Vsc_L for the low brightness display is set to be lower than that of the light emission drive voltage Vsc_H for the high brightness display.

Either of the two kinds of the power source circuits A 42*a* and B 44*a* is selectively used by the switching of the selection of the logic circuit 38*a* as a selecting circuit. That is, in the present embodiment, the supply source itself of the analog power source to be used at the high brightness display time (first display mode) and the low brightness display time (second display mode) is switched.

Hereby, although the drive power source generating circuit 40*a* is a module enabling the execution of the high brightness display, it becomes possible to suppress the power consumption at the drive power source generating circuit 40*a* to be the minimum by stopping the power source supply through the analog power source Vsc of the high electric potential when in the low brightness use, and supplying power source through the analog power source VDDA of low electric potential.

Moreover, it becomes possible to suppress the power consumption furthermore, in the time of the low brightness display, by setting the voltage value of the light emission drive voltage to be applied to the anode line 20 to the voltage Vsc_L smaller than the voltage Vsc_H at the time of the high brightness display.

The selection of the two kinds of the power source circuits A 42*a* and B 44*a* by the logic circuit 38*a* may be performed, for example, in accordance with a control command supplied from the outside of the display module 10*a* as digital data according to the operation state of the equipment provided with the display module 10*a*. In this occasion, for example, if a user performs some operation to the electric device having the display module 10*a*, the display apparatus judges that the apparatus is in a used state, and a control command for setting the display module 10*a* to be the high brightness display state (first display mode) is applied to the logic circuit 38*a*. Then, the logic circuit 38*a* selects the power source circuit A 42*a*. If a period of time while the operation to the display apparatus by a user is not performed judged to exceed a preset predetermined period of time, the display apparatus judges that the apparatus is in a standby state, and a control command for setting the display module 10*b* to be the low brightness display state (second display mode) is applied to the logic circuit 38*a*. Then, the logic circuit 38*a* selects the power source circuit B 44*a*.

Alternatively, in the case that the driver circuit 14*a* includes an illuminance sensor 50, the sensor 50 may detects ambient brightness. Then, for example, if the detected ambient brightness is relatively bright, the logic circuit 38*a* may select the power source circuit A 42*a* to set the apparatus to the high brightness display state (first display mode). If the detected brightness is relatively dark, the logic circuit 38*a* may select the power source circuit B 44*a* to set the apparatus to the low brightness display state (second display mode).

Next, the voltage values of the light emission drive voltages Vsc_L and Vsc_H according to the first embodiment will be described.

Figure 2:
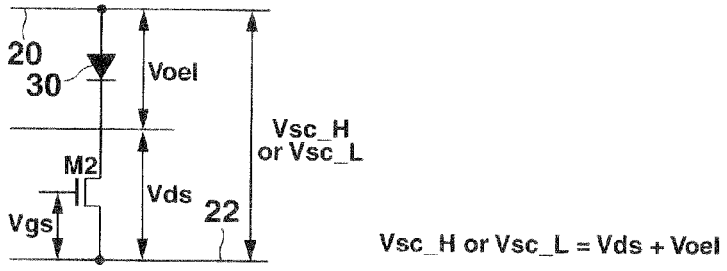
FIG. 2 is a circuit diagram to extract a primary factor part to determine a light emission drive voltage in a pixel drive circuit of a display pixel circuit according to a first embodiment of the present invention.

FIG. 2 is a circuit diagram to extract a primary factor part to determine the light emission drive voltage in the pixel drive circuit of a display pixel Px1 according to the first embodiment. As shown in FIG. 2, when the common wiring 22 is the analog ground voltage VSSA, the light emission drive voltage Vsc_L or Vsc_H is applied between the anode line 20 and the common wiring 22. At this time, the voltage between the drain electrode and the source electrode of the drive transistor M3 is a voltage Vds_3, and the voltage between the anode electrode and the cathode electrode of the organic EL element 30 is a voltage Voled.

In the above light emission control of the organic EL element 30, the drive transistor M2 is set to operate in a saturated region when the display data is maximum brightness gradation and the maximum drive current is flown between the drain electrode and the source electrode of the drive transistor M2 and flown to the organic EL element 30. In this case, even if the voltage Vds between the drain electrode and the source electrode of the drive transistor M2 is fluctuated to some extent by, for example, an increase of the resistance according to a property fluctuation of the organic EL element 30, a current value of the drive current can be prevented from fluctuating. At this time, the voltage values of the light emission drive voltage Vsc_L and Vsc_H are set so that the voltage value between the drain electrode and the source electrode of the drive transistor M2 becomes a voltage that is necessary for the drive transistor to operate in the saturated region when the light emission control of the organic EL element 30 is performed.

Figure 3A:
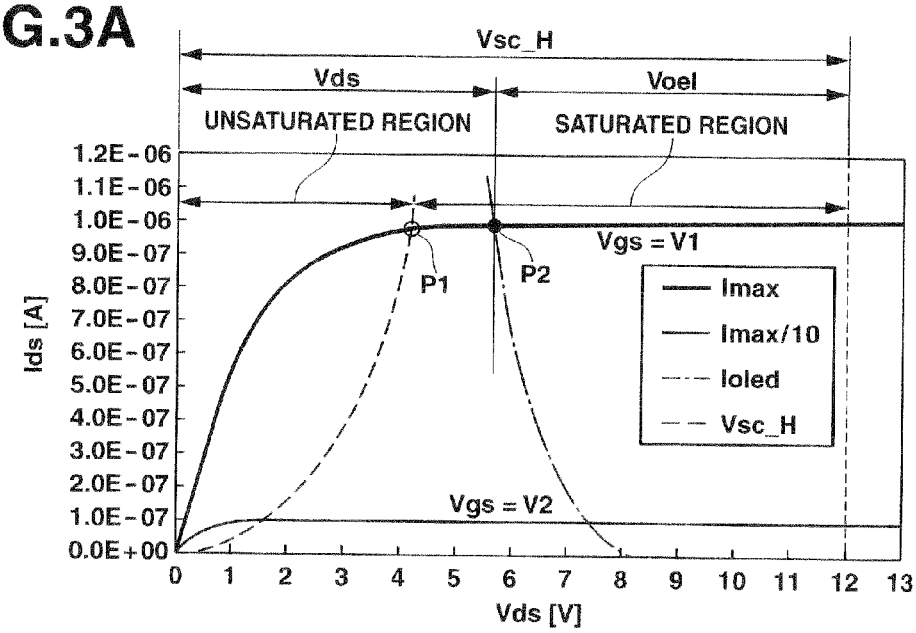
FIG. 3A is a diagram showing actually measured examples of the Vd-Id characteristic of a transistor and the V-I characteristic of an organic EL element in a drive of the maximum light emission current of 1 μA according to a first embodiment of the present invention.
Figure 3B:
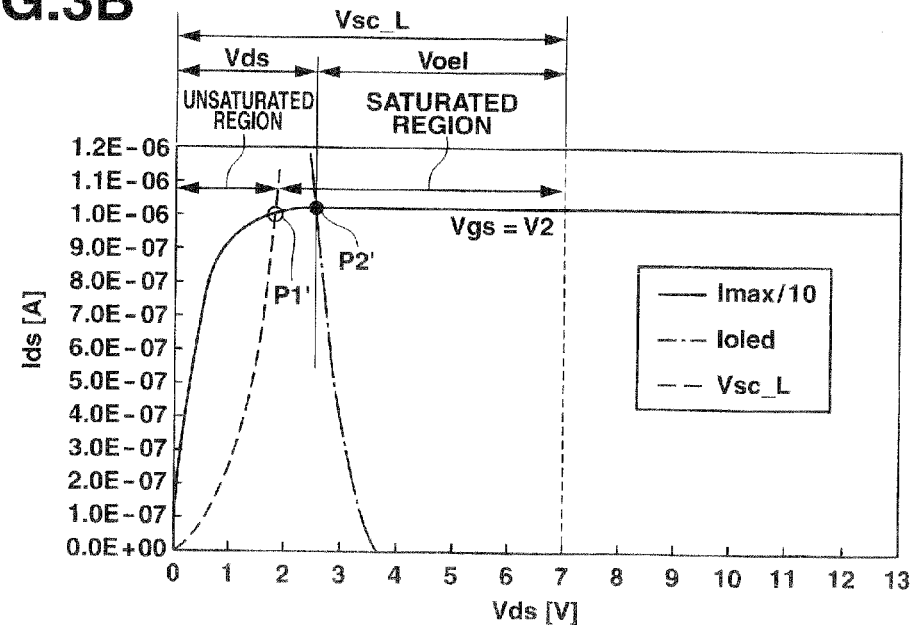
FIG. 3B is a diagram showing actually measured examples of the Vd-Id characteristic of the transistor and the V-I characteristic of the organic EL element in a drive of the maximum light emission current of 1/10 of the one in the case of FIG. 3A (100 nA) according to a first embodiment of the present invention.

FIG. 3A is a diagram showing actually measured examples of the characteristic of the voltage between the drain and the source of the light emission control transistor M2 to the current between the drain and the source thereof (hereinafter referred to as a Vds-Ids characteristic, which is expressed by a thick solid line) and the voltage to current characteristic of the organic EL element 30 (hereinafter referred to as a V-I characteristic, i.e. load characteristic, which is expressed by an alternate long and short dash line) in a drive of a high brightness display of the display data of the maximum brightness gradation at the time of setting the maximum drive current flowing between the drain and the source of the drive transistor M2 to one μA in the first embodiment. FIG. 3B is a diagram showing actually measured examples of the Vds-Ids characteristic (solid line) of the drive transistor M2 and the V-I characteristic (load characteristic, which is expressed by an alternate long and short dash line) of the organic EL element 30 in a drive of a low brightness display of the display data of the maximum brightness gradation at the time of setting the maximum drive current to 1/10 of the one in the case of FIG. 3A (100 nA). Incidentally, in each diagram, points P1 and P1' on the Vds-Ids characteristic lines indicate pinch-off voltages. The region in which the voltage between the drain and the source Vds is from 0 V to the pinch-off voltage P1 or P1' is an unsaturated region, and the region in which the voltage between the drain and the source Vds is equal to or more than the pinch-off voltage P1 or P1' is a saturated region.

In each diagram, the intersecting points P2 and P2' of the respective two curves are the operating points of the drive transistor M2. In the case of FIG. 3A, the operating point P2 is located in the saturated region under the condition of Vsc=12 V. In the case of FIG. 3B, it is found that the operating point P2' is located in the saturated region even if the analog power source Vsc is set to 7 V. Thus it is possible to change the voltage value of a light emission operation voltage to a voltage value necessary for flowing the maximum drive current in the high brightness display state or in the low brightness display state, respectively, as the maximum value of the light emission current changes. Accordingly, it is only necessary to set the light emission drive voltage Vsc_H for the high brightness display by the power source circuit A 42*a* to 12 V in the high brightness display time shown in FIG. 3A, and to set the light emission drive voltage Vsc_L for the low brightness display by the power source circuit B 44*a* to 7 V in the low brightness display time shown in FIG. 3B.

The fact that the light emission current values differed from each other by one digit in the actually measured examples mentioned above indicates that the difference of the maximum value and the minimum value of the output currents of the anode driver 28*a* becomes further larger. That is, it is necessary for the high brightness side to prepare a power source circuit capable of a whole surface lighting drive, and it is possible to design the power source circuit to attain the maximum efficiency by setting the lighting state not to the full lighting but to a substantial one (about 5% to 10% of the full lighting) at the time of dimmer adjusted time on the other hand.

As described above, the display module 10*a* equipped with both the functions of a lower power consumption drive and a high brightness display can be realized by selecting the power source circuits suitably so that the efficiency thereof may become the best at the time of an actual use with the ability of a high brightness display.

It is supposed, for example, that there are sixteen thousand pixels (128×128) in all. If the current per pixel is one μA, then the value of the currents flowing through the anode lines 20 at the time of lightening the whole pixels Px1 becomes 16 mA. On the other hand, if the current per pixel is 100 nA at the time of lightening 10% of the whole pixels, then the value of the currents flowing through the anode lines 20 becomes 160 μA. At this time, it is only necessary for the power source circuit A 42*a* to be designed so as to obtain a high conversion efficiency within the current output range for one digit. On the other hand, it is only necessary for the side of the power source circuit B 44*a* to be designed so as to obtain high conversion efficiency within a range of a small output current.

Moreover, the driver circuit 14*a* may be configured so that, if the maximum brightness of the light emission brightness to be set to the organic EL element 30 of each of the display pixels Px1 according to display data becomes that equal to the maximum brightness at the low brightness display time mentioned above at the time of using the power source circuit A 42*a* as the power source circuit, i.e. at the time of applying and using the light emission drive voltage Vsc_H for the high brightness display, then the drive circuit 14*a* switches the power source circuit to use from the power source circuit A 42*a* to the power source circuit B 44*a* automatically so as to apply and use the light emission drive voltage Vsc_L for the low brightness display. Hereby, power saving can be performed.

Figure 4:
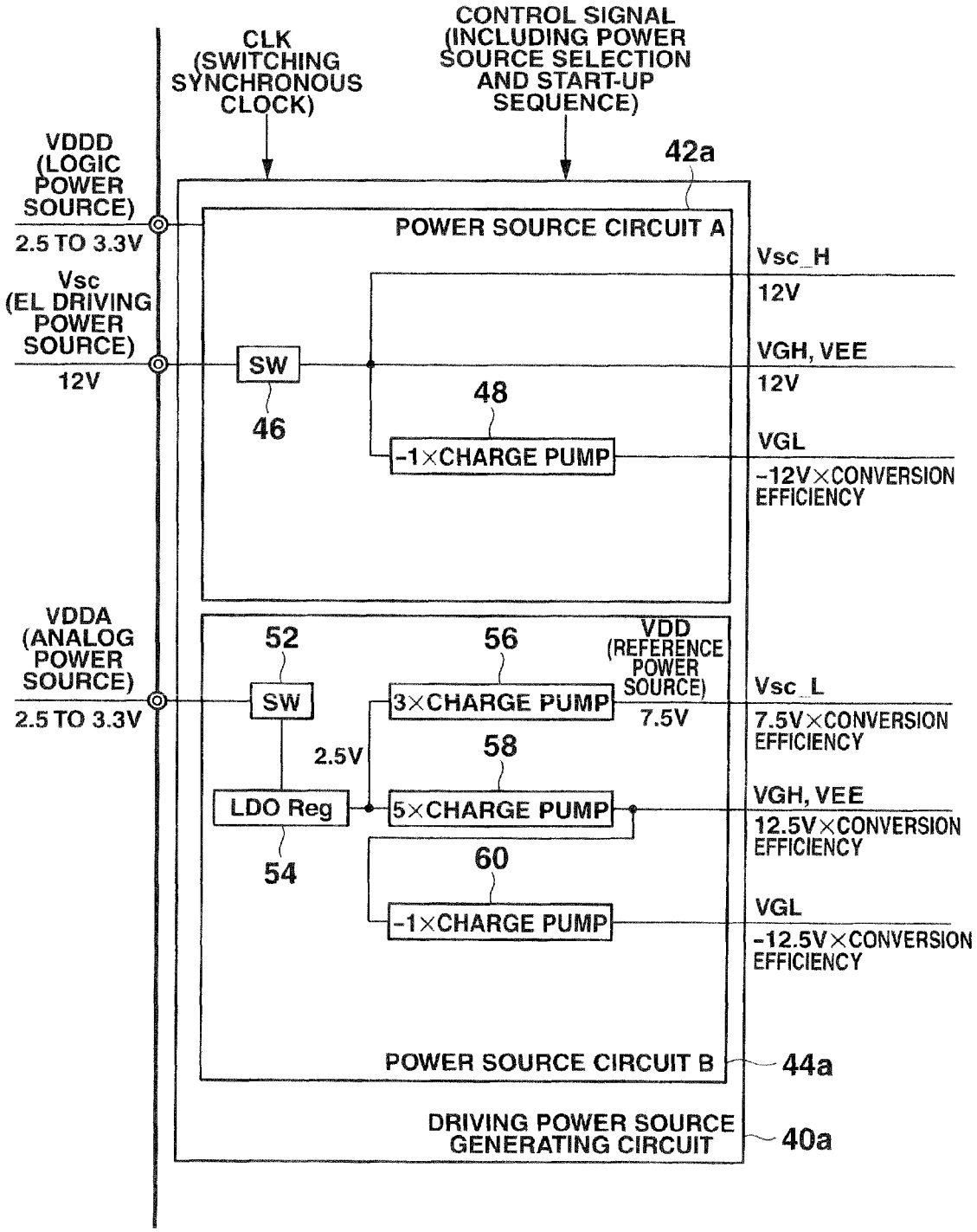
FIG. 4 is a diagram showing the concrete configuration examples of two power source circuits of a drive power source generating circuit according to a first embodiment of the present invention.

FIG. 4 is a diagram showing an example of a concrete configuration of the drive power source generating circuit 40*a* according to the first embodiment.

In FIG. 4, a concrete configuration examples are shown, in which the power source circuit A 42*a* of the drive power source circuit 40*a* generates the above mentioned light emission drive voltage Vsc_H of 12 V, and the power source circuit B 44*a* generates the light emission drive voltage of 7 V.

These are the examples of using step-up type switching power sources by capacitor-based charge pump converters (charge pump circuits).

That is, the power source circuit A 42*a* includes a switch (hereinafter simply referred to as SW) 46 and a charge pump circuit 48 of −1 time. The SW 46 switches the analog power source Vsc supplied from the outside between the transmission thereof to the subsequent stage and the un-transmission thereof to the subsequent stage according to the selection by a control signal from the logic circuit 38*a*. Incidentally, the switching timing thereof is further accurately adjusted in synchronization with a switching synchronization clock CLK given from the TG 36*a*. The charge pump circuit 48 of −1 time boosts the analog power source Vsc supplied through the SW 46 by −1 time.

For example, the analog power source Vsc is an EL drive power source of 12 V generated by a not shown power source circuit of the equipment in which the display module 10*a* is incorporated. Accordingly, the power source circuit A 42*a* outputs the voltage 12 V as it is as the gate selection voltage VGH, the data driver drive power source voltage VEE and the light emission drive voltage Vsc_H. Moreover, the power source circuit A 42*a* boosts the voltage 12 V by −1 time with the charge pump circuit 48 of −1 time and outputs the boosted voltage as the gate non-selection voltage VGL of −12 V (actually the loss for the conversion efficiency thereof exists).

Moreover, the power source circuit B 44*a* includes, for example, a SW 52, a low drop-out regulator (hereinafter referred to as LDO regulator) 54, a charge pump circuit 56 of 3 times, a charge pump circuit 58 of 5 times, and a charge pump circuit 60 of −1 time. The SW 52 switches the analog power source VDDA supplied from the outside between the transmission thereof to the subsequent stage and the un-transmission thereof to the subsequent stage according to the selection by a control signal from the logic circuit 38*a*. Incidentally, the switching timing is further accurately adjusted in synchronization with the switching synchronization clock CLK given from the TG 36*a*. The LDO regulator 54 regulates an input voltage within a predetermined voltage range to a constant analog voltage and outputs the regulated voltage. The LDO regulator 54 regulates the analog power source voltage VDDA supplied through the SW 52 to a predetermined constant analog voltage to output the regulated analog voltage. The charge pump circuit 56 of 3 times boosts the predetermined analog voltage output from the LDO regulator 54 by 3 times. The charge pump circuit 58 of 5 times boosts the analog voltage boosted by the charge pump circuit 56 of 3 times by 5 times. The charge pump circuit 60 of −1 time boosts the analog voltages boosted by the charge pump circuit 58 of 5 times by −1 time.

As the analog power source voltage VDDA, for example, a logic voltage that is used by the equipment in which the display module 10*a* is incorporated is utilized. The voltage value of the logic voltage varies depending on the equipment in which the display module 10*a* is incorporated, and, for example, a voltage within a range of about from 2.5 V to about 3.3 V is supplied. Accordingly, the power source circuit B 44*a* regulates the voltage of from 2.5 V to 3.3 V with the LDO regulator 54 to obtain a constant analog voltage of 2.5 V. Then, the power source circuit B 44*a* boosts the analog voltage of 2.5 V by 3 times with the charge pump circuit 56 of 3 times to output the boosted analog voltage as the light emission drive voltage of 7.5 V (actually the loss for the conversion efficiency thereof exists). Moreover, the power source circuit B 44*a* also boosts the analog voltage by 5 times with the charge pump circuit 58 of 5 times and outputs the boosted analog voltage as the gate selection voltage VGH and the data driver drive power source voltage VEE of 12.5 V (actually the loss for the conversion efficiency thereof exists). Moreover, the power source circuit B 44*a* boosts the analog voltage of 12.5 V (actually the loss for the conversion efficiency thereof exists), obtained by boosting 5 times with the charge pump circuit 58 of 5 times, by −1 time with the charge pump circuit 60 of −1 time and outputs the boosted analog voltage as the gate non-selection voltage VGL of −12.5 V (actually the loss for the conversion efficiency thereof exists).

Incidentally, the configuration of the power source circuits are not limited to those ones described above, but any configurations may be used as long as the configurations are the power sources capable of being incorporated in the display module 10*a* in a semiconductor process, such as a step-up type switching power source using an inductor based boost converter.

According to the first embodiment described above, even in the active matrix display module subjected to the dimmer processing of the large dynamic range at the maximum brightness, the light emission drive voltage at a time of the low brightness display is controlled to be lower than the light emission drive voltage at a time of the high brightness display. The display module includes two power source circuits including a power source circuit designed to generate a light emission drive voltage for the low brightness display with high efficiency and a power source circuit designed to generate a light emission drive voltage for the high brightness display with high efficiency. The display module is configured so that the power source circuit, an efficiency of which is most appropriate, is selected at a time of the low brightness display and at a time of the high brightness display. Thereby, the present embodiment makes it possible to cope with both of a high brightness display and low power consumption at a time of the low brightness display.

Second Embodiment

Next, a display apparatus according to a second embodiment of the present invention will be described with reference to the drawings.

Figure 5:
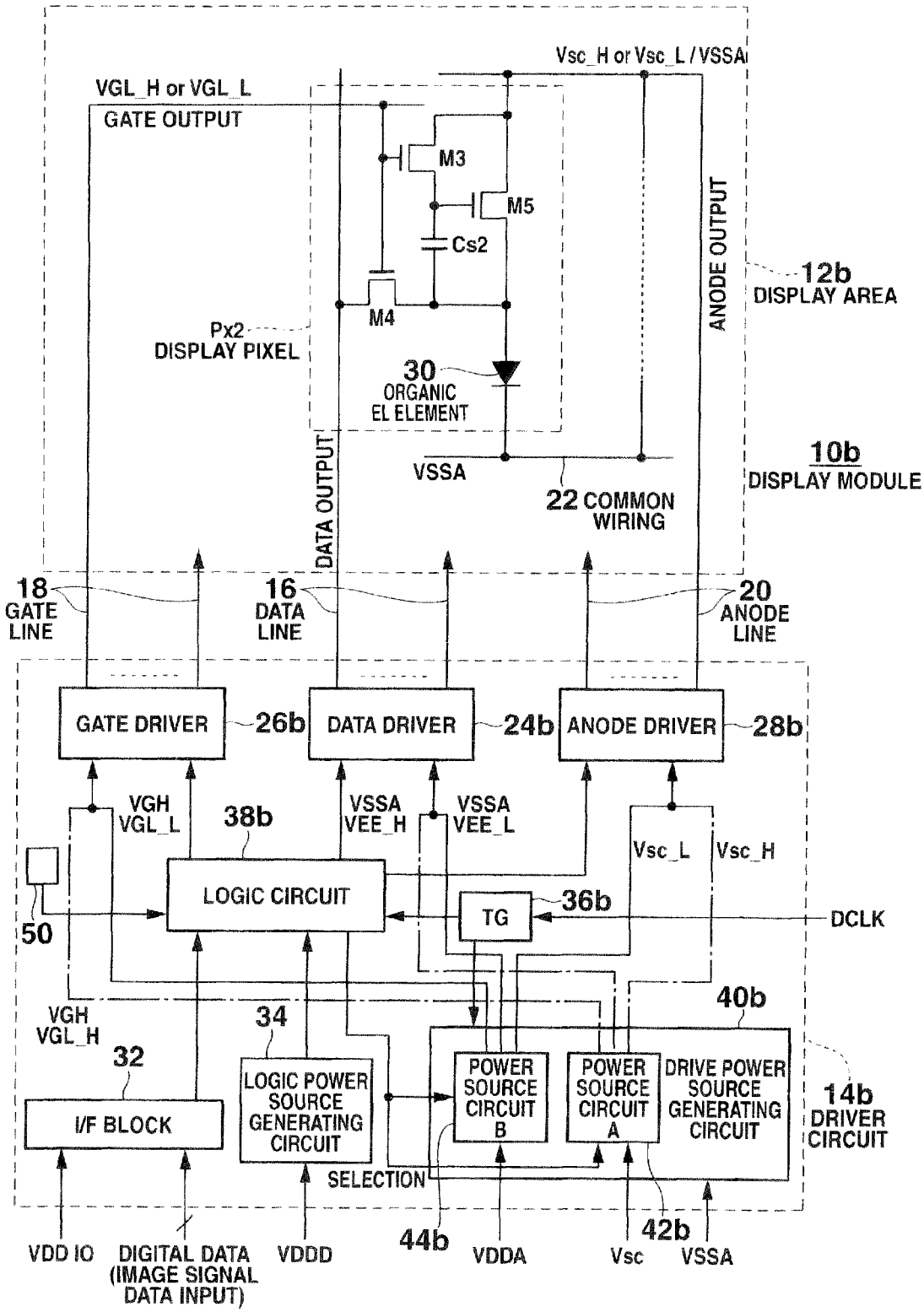
FIG. 5 is a diagram showing the schematic configuration of an active matrix drive system display module according to a second embodiment of the present invention.

FIG. 5 is a diagram showing the schematic configuration of an active matrix drive system display module 10*b* according to the embodiment of the present invention.

Here, configurations that are same as in the above mentioned FIG. 1 will be explained with the same or coequal reference numerals.

The display module (display apparatus) 10*b* according to the second embodiment includes a display area 12*b*, in which a plurality of pixels is arranged in a matrix, and a driver circuit (driving circuit) 14*b* disposed in the neighborhood of the display area 12*b*.

The display area 12*b* includes n (a plurality of) data lines 16 arranged to be in parallel with one another, m (a plurality of) gate liens 18 arranged so as to be perpendicular to the data lines 16 and to be in parallel with one another, m (a plurality of) anode lines 20 arranged between each of the gate lines 18 and to be in parallel with the gate lines 18, a plurality of (m×n) display pixels Px2 arranged along the data lines 16 and the gate liens 18 to be in a matrix, and common wiring 22, to which a predetermined electric potential (for example, the analog ground voltage VSSA) is applied. Incidentally, m and n severally indicates a natural number of two or more.

A drive voltage V, which is a signal voltage according to display data, is applied from a data driver (data drive circuit) 24*b* of the driver circuit 14*b* to each of the data lines 16. Moreover, a gate output, which is a scanning voltage having the electric potentials of the high level thereof as a gate selection voltage VGH and the low level thereof as a gate non-selection voltage VGL_L or VGL_H, is applied from a gate driver (scan drive circuit) 26b of the driver circuit 14*b* to each of the gate lines 18. Then, a power source voltage (anode output) having the electric potentials of the high level thereof as a light emission drive voltage Vsc_L or Vsc_H and the low level thereof as, for example, the analog ground voltage VSSA is applied from an anode driver (power source drive circuit) 28*b* of the driver circuit 14*b* to each of the anode lines 20. Incidentally, the gate non-selection voltage VGL_L or VGL_H and the light emission drive voltage Vsc_L or Vsc_H will be described later.

Any of the display pixels Px2 is configured to be the same, and accordingly one configuration of them is representatively shown in FIG. 1.

The display pixel Px2 includes an organic EL element 30 as a light emitting element and a pixel drive circuit, disposed in the neighborhood of the organic EL element 30, equipped with, for example, three N channel type amorphous silicon thin film transistors (hereinafter simply referred to as transistors) M3, M4, and M5 and a capacitor Cs2. In the following, the transistors M3, M4, and M5 will be referred to as a drive control transistor M3, a writing control transistor M4, and a light emission control transistor M5, respectively. Moreover, the capacitor Cs2 will be referred to as a holding capacitor Cs2.

The source electrode of the drive control transistor M3 is connected to the gate electrode of the light emission control transistor M5 and one electrode of the holding capacitor Cs2; the drain electrode of the drive control transistor M3 is connected to the drain electrode of the light emission control transistor M5 and a corresponding anode line 20; and the gate electrode of the drive control transistor M3 is connected to the gate electrode of the writing control transistor M4 and a corresponding gate line 18.

The source electrode of the light emission control transistor M5 is connected to the anode electrode of the organic EL element 30, the drain electrode of the writing control transistor M4, and the other electrode of the holding capacitor Cs2; the drain electrode of the light emission control transistor M5 is connected to the drain electrode of the drive control transistor M3 and the anode line 20; and the gate electrode of the light emission control transistor M5 is connected to the source electrode of the drive control transistor M3 and the one electrode of the holding capacitor Cs2.

The anode electrode of the organic EL element 30 is connected to the drain electrode of the writing control transistor M4, the source electrode of the light emission control transistor M5, and the other electrode of the holding capacitor Cs2; and the cathode electrode of the organic EL element 30 is connected to the common wiring 22.

On the other hand, the driver circuit 14*b* includes an interface (hereinafter simply referred to as I/F) block 32, a logic power source generating circuit 34, a timing generator (hereinafter simply referred to as TG) 36*b*, a logic circuit 38*b*, and a drive power source generating circuit 40*b* in addition to the data driver 24*b*, the gate driver 26*b*, and the anode driver 28*b*, mentioned above.

The I/F block 32 operates by an interface power source VDDIO supplied from the outside and receives an image signal data input, a control command, and the like, transmitted from the outside as digital data to supply the received signals to the logic circuit 38*b*. The logic power source generating circuit 34 generates a logic voltage for operating the logic circuit 38*b* on the basis of a logic power source voltage VDDD supplied from the outside. The TG 36*b* controls the operation timing of the logic circuit 38*b* and the drive power source generating circuit 40*b* on the basis of a dot clock DCLK supplied from the outside.

The logic circuit 38*b* performs the control, of the data driver 24*b*, the gate driver 26*b*, and the anode driver 28*b* in accordance with digital data from the I/F block 32.

That is, the gate driver 26*b* is a scanning and driving unit to set each of the display pixels Px2 in each row to the selection state thereof in order by applying a scanning signal voltage (gate output) to each of the gate lines 18 in the display area 12*b* in order by the use of the gate selection voltage VGH and the gate non-selection voltage VGL_L or VGL_H, generated in the drive power source generating circuit 40*b*. The logic circuit 38*b* controls the scanning timing of the gate driver 26*b*.

Moreover, the data driver 24*b* is a signal drive unit to generate a drive voltage having a voltage value according to display data, and supplies the generated drive voltage through the data lines 16 to each of the display pixels Px2 in a row in the display area 12*b* set to the selection state thereof by the gate driver 26*b* by the use of a data driver drive power source voltage VEE_L or VEE_H of a negative polarity generated by the drive power source generating circuit 40*b*. The logic circuit 38*b* generates the display data on the basis of an image signal data input from the outside. Incidentally, the data driver 24*b* includes, for example, a digital to analog (D/A) converter for generating a negative polarity drive voltage according to the gradation value of a display signal on the basis of a plurality of gradation voltages set in advance, a γ circuit for suitably setting the value of each gradation of a gradation voltage (called as a γ characteristic). The plurality of negative polarity gradation voltages are generated on the basis of the data driver drive power source voltage VEE_L or VEE_H from the drive power source generating circuit 40*b*. Incidentally, the data driver drive power source voltage VEE_L or VEE_H and the analog ground voltage VSSA are in a relation of VEE_H<VEE_L<VSSA. The data driver drive power source voltage VEE_L is set to have lower electric potential than the analog ground voltage VSSA, and the data driver drive power source voltage VEE_H is set to have lower electric potential than the data driver drive power source voltage VEE_L.

The anode driver 28*b* applies an anode output to the anode line 20 by the use of the light emission drive voltages Vsc_L and Vsc_H generated by the drive power source generating circuit 40*b*, and the logic circuit 38*b* controls the application timing thereof.

The drive power source generating circuit 40*b* generates various voltages to be supplied to the respective sections of the display module 10*b* on the basis of the analog power sources Vsc and VDDA supplied from the outside. That is, the drive power scarce generating circuit 40*b* generates the data driver drive power source voltages VEE_L and VEE_H to be supplied to the data driver 24*b*, the gate selection voltage VGH and the gate non-selection voltage VGL_L and VGL_H to be supplied to the gate driver 26*b*, the light emission drive voltages Vsc_L and Vsc_H to be supplied to the anode driver 28*b*, and the like.

The display module 10*b* having the configuration described above is configured to perform the light emission control of the organic EL element 30 as shown in the following by performing on-off control of the three transistors M3, M4, and M5 by the pixel drive circuit, in each of the display pixels Px2 in the display area 12*b*.

That is, the light emission drive control of the organic EL element 30 is executed by setting a writing operation period (or the selection period of a display pixel) and a light emission operation period (or the non-selection period of a display pixel) in a scanning period under the setting of the scanning period as one cycle, for example. In the writing operation period, each of the display pixels Px2 connected to a specific gate line 18 is selected, and the signal current according to the drive voltage corresponding to the brightness gradation of display data is written in the selected display pixel Px2. Then, the voltage corresponding to the signal current is held as a signal voltage. In the light emission operation period, the drive current according to the display data is supplied to the organic EL element 30 on the basis of the signal voltage, written and held in the writing operation period to perform a light emission operation in a predetermined brightness gradation. Incidentally, (one scanning period)=(the writing operation period)+(the light emission operation period), and the writing operation period to be set to each row is set lest no overlapping in time should be mutually produced.

In the writing operation period to a display pixel Px2, a gate output of the high level (gate selection voltage VGH_L or VGH_H) is applied to the gate line 18 in a specified row from the gate driver 26*b* of the driver circuit 14*b*, and a predetermined electric potential of the low level (for example, the analog ground voltage VSSA) is applied to the anode line 20 of the row from the anode driver 28*b* of the driver circuit 14*b*. Moreover, a drive voltage having a negative polarity voltage value corresponding to the brightness gradation of the display data corresponding to each of the display pixels Px2 in the row, which is taken in by the data driver 24*b*, is supplied to each of the data lines 16 in synchronization with the timing.

Hereby, the drive control transistor M3 and the writing control transistor M4, constituting the pixel drive circuit of the display pixel Px2, performs turning-on operation. Then, the analog ground voltage VSSA is applied to the gate electrode of the light emission control transistor M5 and one end of the holding capacitor Cs2, and the operation by which the signal current according to the negative polarity drive voltage is drawn in through the data line 16 is performed. Thereby, the voltage level of a lower potential than the analog ground voltage VSSA is applied to the source electrode of the light emission control transistor M5 and the other end of the holding capacitor Cs2.

A potential difference is generated between the gate electrode and the source electrode of the light emission control transistor M5 in such a way, and consequently the light emission control transistor M5 performs a turning-on operation, and a signal current flows from the anode line 20 to the data driver 24*b* through the light emission control transistor M5, the writing control transistor M4, and the data line 16.

At this time, the electric charge corresponding to the potential difference generated between the gate electrode and the source electrode of the light emission control transistor M5 is accumulated (written) in the holding capacitor Cs2, and the accumulated charge is held (charged) as a voltage component. Moreover, the analog ground voltage VSSA is applied to the anode line 20, and the signal current is controlled to flow toward the data line 16. Consequently, the electric potential applied to the anode of the organic EL element 30 becomes lower than that of the cathode thereof (the analog ground voltage VSSA), and a reverse bias voltage is applied to the organic EL element 30. Consequently, no currents flow through the organic EL element 30, and no light emission operations thereof are performed.

Next, in the light emission operation period of the organic EL element 30 after the end of the writing operation period, a low level gate output (gate non-selection voltage VGL_L or VGL_H) is applied from the gate driver 26*b* to the gate line 28*b* in a specified row, and the high level light emission drive voltage Vsc_L or Vsc_H is applied from the anode driver 28*b* to the anode line 20 in the row. Moreover, the drawing operation of the gradation current by the data driver 24*b* is stopped in synchronization with the timing.

Hereby, the drive control transistor M3 end the writing control transistor M4, both constituting the pixel drive circuit of the display pixel Px2, perform turning-off operations, and the application of the analog ground voltage VSSA to the gate electrode of the light emission control transistor M5 and the one end of the holding capacitor Cs2 are intercepted. Furthermore, the application of the voltage level caused by the drawing operation of the signal current by the data driver 24*b* to the source electrode of the light emission control transistor M5 and the other end of the holding capacitor Cs2 is intercepted. Consequently, the holding capacitor Cs2 holds the electric charge accumulated in the writing operation described above.

The potential difference between the gate electrode and the source electrode of the light emission control transistor M5 is held by the holding of the charged voltage at the wiring operation by the holding capacitor Cs2 as described above, and the light emission control transistor M5 keeps its on-state. Moreover, since the light emission drive voltage Vsc_L or Vsc_H of a voltage level higher than the analog ground voltage VSSA is applied to the anode line 20, the electric potential applied to the anode electrode of the organic EL element 30 is higher than that of the cathode electrode thereof (the analog ground voltage VSSA).

Consequently, a predetermined drive current flows through the organic EL element 30 from the anode line 20 toward the forward bias direction of the organic EL element 30 through the light emission control transistor M5, and the organic EL element 30 emits a light. Since the potential difference held in the holding capacitor Cs2 (charged voltage) corresponds to the potential difference in the case of flowing the signal current according to a drive voltage through the light emission control transistor M5 here, the drive current flowing through the organic EL element 30 has the current value equal to the signal current mentioned above. Hereby, in the light emission operation period after the writing operation period, the drive current is continuously supplied through the light emission control transistor M5 on the basis of the voltage component corresponding to the display data (drive voltage) written in the writing operation period, and the organic EL element 30 continues the operation of emitting a light in the brightness gradation corresponding to the display data.

Then, by executing the series of operations described above to the display pixel s Px2 in all of the rows constituting the display area 12*b* repeatedly, each of the display pixels Px2 in the display area 12*b* emits a light in the brightness gradation according to the display data, and consequently desired image information is displayed.

Then, in the second embodiment, the drive power source generating circuit 40*b* is equipped with two kinds of power source circuits of a power source circuit A (first power source circuit) 42*b* and a power source circuit B (second power source circuit) 44*b*. The power source circuit A 42*b* is a power source circuit to function at the time when the maximum brightness set to the organic EL elements 30 of the display pixels Px2 is relatively high and the output currents are large at the time of the maximum gradation of display data, and generates the data driver drive power source voltage VEE_H (second voltage), the gate selection voltage VGH and the gate non-selection voltage VGL_H (second voltage), the light emission drive voltage Vsc_H (first voltage), and the like, for a high brightness display on the basis of the analog power source Vsc with high efficiency here. Moreover, the power source circuit B 44*b* is a power source circuit to function at the time when the maximum brightness set to the organic EL elements 30 of the display pixels Px2 is relatively low and the output current value is small at the time of the maximum gradation of display data, and generates the data driver drive power source; voltage VEE_L (second voltage), the gate selection voltage VGH and the gate non-selection voltage VGL_L (second voltage), the light emission drive voltage Vsc_L (first voltage), and the like, for a low brightness display on the basis of the analog power source VDDA with high efficiency. Incidentally, the analog power sources Vsc and VDDA, the gate selection voltage VGH, and the gate non-selection voltage VGL are in a relation of: $Vsc \geqq Vsc_H > Vsc_L \geqq VDDA$. The electric potential of the analog power source VDDA is set to be lower than that of the analog power source Vsc, and the electric potential of the light emission drive voltage Vsc_L for the low brightness display is set to be lower than that of the light emission drive voltage Vsc_H for the high brightness display.

Either of the two kinds of the power source circuits A 42*b* and B 44*b* is selectively used by the switching of the selection of the logic circuit 38*b* as a selecting circuit. That is, in the present embodiment, the supply source itself of the analog power source to be used at the high brightness display time (first display mode) and the low brightness display time (second display mode) is switched.

Hereby, although the drive power source generating circuit 40*a* is a module enabling the execution of the high brightness display, it becomes possible to suppress the power consumption at the drive power source generating circuit 40*b* to be the minimum by stopping the power source supply through the analog power source Vsc of the high electric potential when in the low brightness use, and supplying power source through the analog power source VDDA of low electric potential.

Moreover, it becomes possible to suppress the power consumption furthermore, in the time of the low brightness display, by setting the voltage value of the light emission drive voltage to be applied to the anode line 20 to the voltage Vsc_L smaller than the voltage Vsc_H at the time of the high brightness display, by setting the absolute value of the gate non-selection voltage to the voltage VGL_L smaller than the voltage VGL_H at the time of the high brightness light emission, and by setting the absolute value of the data driver drive power source voltage to the voltage VEE_L smaller than the voltage VEE_H at the time of the high brightness light emission.

The selection of the two kinds of the power source circuits A 42*b* and B 44*b* by the logic circuit 38*b* may be performed, for example, in accordance with a control command supplied from the outside of the display module 10*b* as digital data according to the operation state of the equipment provided with the display module 10*b*. In this occasion, for example, if a user performs some operation to the electric device having the display module 10*b*, the display apparatus judges that the apparatus is in a used state, and a control command for setting the display module 10*b* to be the high brightness display state (first display mode) is applied to the logic circuit 38*b*. Then, the logic circuit 38*b* selects the power source circuit A 42*b*. If a period of time while the operation to the display apparatus by a user is not performed judged to exceed a preset predetermined period of time, the display apparatus judges that the apparatus is in a standby state, and a control command for setting the display module 10*b* to be the low brightness display state (second display mode) is applied to the logic circuit 38*b*. Then, the logic circuit 38*b* selects the power source circuit B 44*b*.

Alternatively, in the case that the driver circuit 14*b* includes an illuminance sensor 50, the sensor 50 may detects ambient brightness. Then, for example, if the detected ambient brightness is relatively bright, the logic circuit 38*b* may select the power source circuit A 42*b* to set the apparatus to the high brightness display state (first display mode). If the detected brightness is relatively dark, the logic circuit 38*b* may select the power source circuit B 44*b* to set the apparatus to the low brightness display state (second display mode).

Next, the voltage values of the light emission drive voltages Vsc_L and Vsc_H according to the second embodiment will be described.

Figure 6:
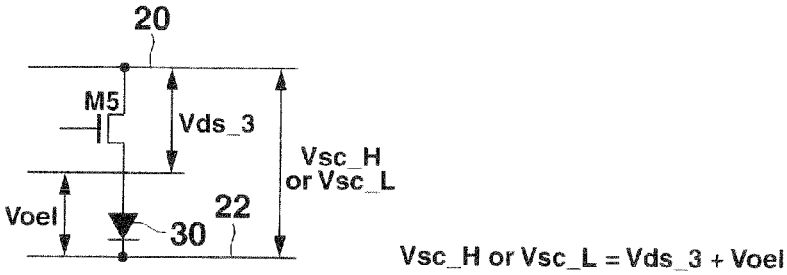
FIG. 6 is a circuit diagram to extract a primary factor part to determine a light emission drive voltage in a pixel drive circuit of a display pixel circuit according to a second embodiment of the present invention.

FIG. 6 is a circuit diagram to extract a primary factor part to determine the light emission drive voltage in the pixel drive circuit of a display pixel Px2 according to the second embodiment. As shown in FIG. 6, when the common wiring 22 is the analog ground voltage VSSA, the light emission drive voltage Vsc_L or Vsc_H is applied between the anode line 20 and the common wiring 22. At this time, the voltage between the drain electrode and the source electrode of the drive transistor M3 is a voltage Vds_3, and the voltage between the anode electrode and the cathode electrode of the organic EL element 30 is a voltage Voled.

In order that the current value of the signal current flowing between the drain and the source of the light emission control transistor M5 in a writing operation period and the current value of the drive current flowing through the organic EL element 30 through the light emission control transistor M5 in a light emission operation period may be set to be almost equal, the operating point of the light emission control transistor M5 is set to be in the saturated region thereof in both of the writing operation period and the light emission operation period. Hereby, the minimum required voltage value for the voltage Vds (herein after referred to as the voltage Vds_3) between the drain and the source of the light emission control transistor M5 can be determined on the basis of the characteristic of the voltage between the drain and the source of the light emission control transistor M5 to the current between the drain and the source thereof and the current-voltage characteristic of the organic EL element 30.

Figure 7A:
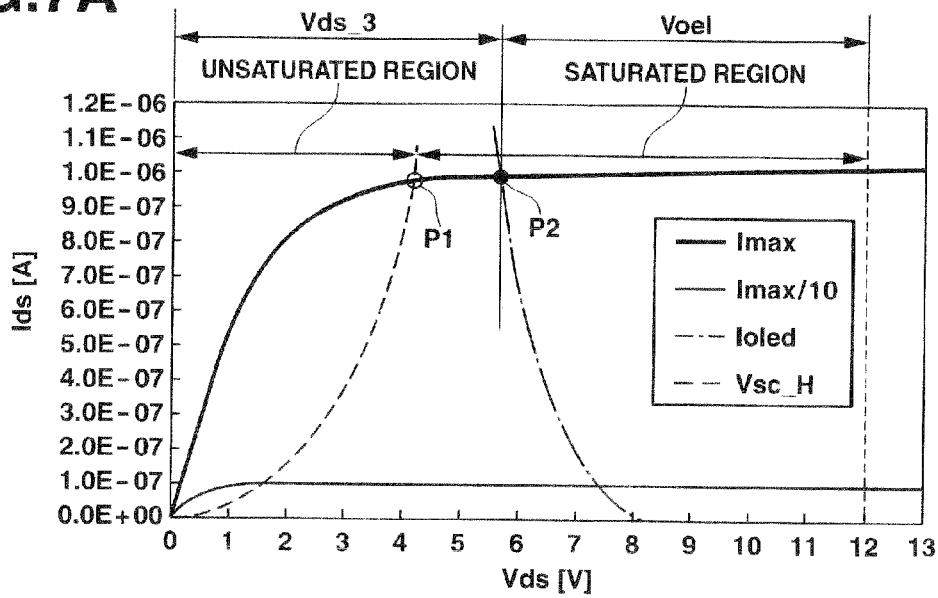
FIG. 7A is a diagram showing actually measured examples of the Vd-Id characteristic of a transistor and the V-I characteristic of an organic EL element in a drive of the maximum light emission current of 1 μA according to a second embodiment of the present invention.
Figure 7B:
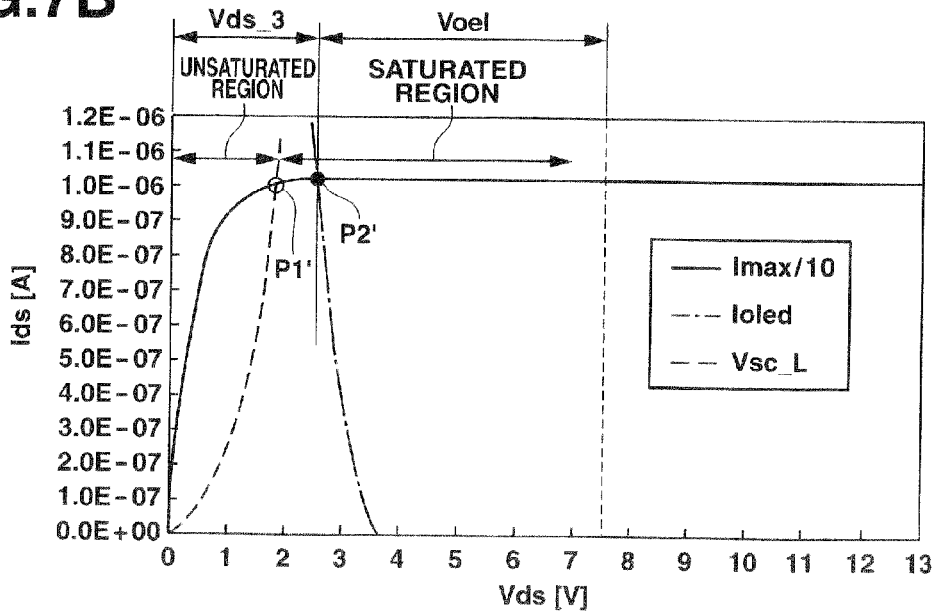
FIG. 7B is a diagram showing actually measured examples of the Vd-Id characteristic of the transistor and the V-I characteristic of the organic EL element in a drive of the maximum light emission current of 1/10 of the one in the case of FIG. 3A (100 nA) according to a second embodiment of the present invention.

FIG. 7A is a diagram showing actually measured examples of the characteristic of the voltage between the drain and the source of the light emission control transistor M5 to the current between the drain and the source thereof (hereinafter referred to as a Vds-Ids characteristic, which is expressed by a thick solid line) and the voltage to current characteristic of the organic EL element 30 (hereinafter referred to as a V-I characteristic, which is expressed by an alternate long and short dash line) in a drive of a high brightness display of the display data of the maximum brightness gradation at the time of setting the maximum drive current flowing between the drain and the source of the light emission control transistor M5 to one μA in the second embodiment. FIG. 7B is a diagram showing actually measured examples of the Vds-Ids characteristic (solid line) of the light emission control transistor M5 and the V-I characteristic (load characteristic, which is expressed by an alternate long and short dash line) of the organic EL element 30 in a drive of a low brightness display of the display data of the maximum brightness gradation at the time of setting the maximum drive current to 1/10 of the one in the case of FIG. 7A (100 nA) in the second embodiment. Incidentally, in each diagram, points P1 and P1' on the Vds-Ids characteristic lines indicate pinch-off voltages. The region in which the voltage between the drain and the source Vds is from 0 V to the pinch-off voltage P1 or P1' is an unsaturated region, and the region in which the voltage between the drain and the source Vds is equal to or more than the pinch-off voltage P1 or P1' is a saturated region.

In each diagram, the intersecting points P2 and P2' of the respective two curves are the operating points of the light emission control transistor M5. In the case of FIG. 7A, the operating point P2 is located in the saturated region under the condition of Vsc=12 V. In the case of FIG. 7B, it is found that the operating point P2' is located in the saturated region even if the analog power source Vsc is set to 7.5 V (i.e. Vsc=7.5 V). Thus it is possible to change the voltage value of a light emission operation voltage to a light emission drive voltage Vsc_H or Vsc_L having the voltage value necessary for flowing the maximum drive current in the high brightness display state or in the low brightness display state, respectively, as the maximum value of the light emission current changes. Accordingly, it is only necessary to set the light emission drive voltage Vsc_H for the high brightness display by the power source circuit A 42*b* to 12 V or more in the high brightness display time shown in FIG. 7A, and to set the light emission drive voltage Vsc_L for the low brightness display by the power source circuit B 44*b* to 7.5 V or more in the low brightness display time shown in FIG. 7B.

The fact that the light emission current values differed from each other by one digit in the actually measured examples mentioned above indicates that the difference of the maximum value and the minimum value of the output currents of the anode driver 28*b* becomes further larger. That is, it is necessary for the high brightness side to prepare a power source circuit capable of a whole surface lighting drive, and it is possible to design the power source circuit to attain the maximum efficiency by setting the lighting state not to the full lighting but to a substantial one (about 5% to 10% of the full lighting) at the time of dimmer adjusted time on the other hand.

As described above, the display module 10*b* equipped with both the functions of a lower power consumption drive and a high brightness display can be realized by selecting the power source circuits suitably so that the efficiency thereof may become the best at the time of an actual use with the ability of a high brightness display.

It is supposed, for example, that there are sixteen thousand pixels (128×128) in all. If the current per pixel is one μA, then the value of the currents flowing through the anode lines 20 at the time of lightening the whole pixels Px2 becomes 16 mA. On the other hand, if the current per pixel is 100 nA at the time of lightening 10% of the whole pixels, then the value of the currents flowing through the anode lines 20 becomes 160 μA. At this time, it is only necessary for the power source circuit A 42*b* to be designed so as to obtain a high conversion efficiency within the current output range for one digit. On the other hand, it is only necessary for the side of the power source circuit B 44*b* to be designed so as to obtain high conversion efficiency within a range of a small output current.

Moreover, the driver circuit 14*b* may be configured so that, if the maximum brightness of the light emission brightness to be set to the organic EL element 30 of each of the display pixels Px2 according to display data becomes that equal to the maximum brightness at the low brightness display time mentioned above at the time of using the power source circuit A 42*b* as the power source circuit, then the drive circuit 14*b* switches the power source circuit to use from the power source circuit A 42*b* to the power source circuit B 44*b* automatically. Hereby, power saving can be performed.

Next, the voltage values of the data driver drive power source voltages VEE_L and VEE_H and the gate non-selection voltages VGL_L and VGL_H will be described.

Figure 8:
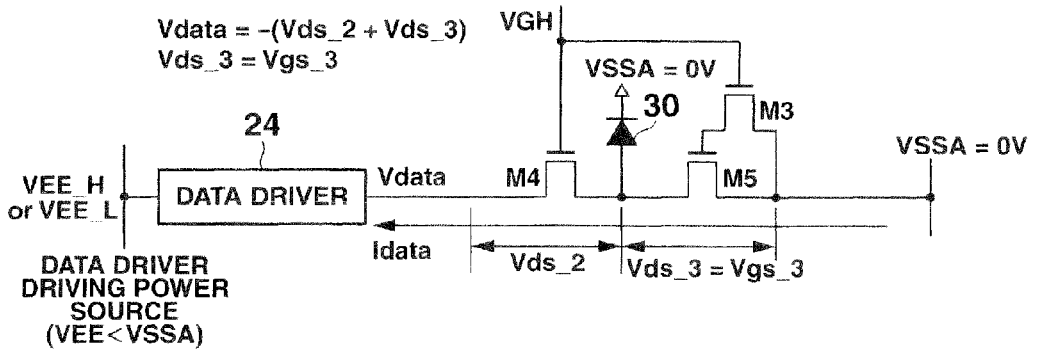
FIG. 8 is a circuit diagram to extract a primary factor part to determine a drive voltage at a writing operation time of the pixel drive circuit of the display pixel according to a second embodiment of the present invention.

FIG. 8 is a circuit diagram to extract a primary factor part to determine a drive voltage at a writing operation time of the pixel drive circuit of each of the display pixels Px2 according to the second embodiment.

Data is held in the display pixel Px2 by setting the source potential of the light emission control transistor M5 by short-circuiting the gate and the drain thereof. At this time, since there is a voltage drop for the voltage Vds between the drain and the source of the writing control transistor M4 (hereinafter referred to as Vds_2), data voltage Vdata becomes Vdata=−(Vds_2+Vds_3)+VSSA on the basis of the sum of the voltage Vds_3 between the drain and the source of the light emission control transistor M5 and the voltage Vds_2 between the drain and the source of the writing control transistor M4. It is supposed that the current flowing from the anode line 20 to the data driver 24*b* through the light emission control transistor M5, the writing control transistor M4, and the data line 16 at this time is expressed as a data current Idata.

Figure 9A:
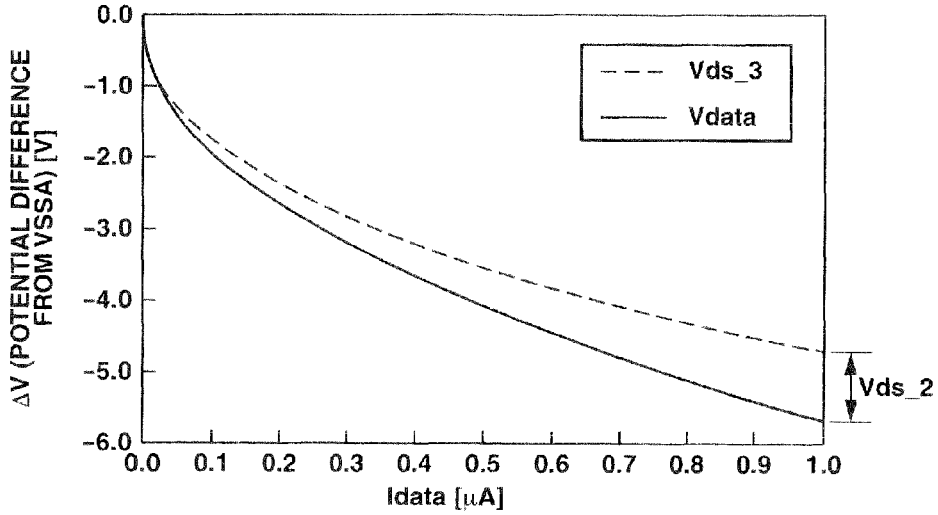
FIG. 9A is a diagram showing a relationship between a data voltage Vdata and a data current Idata according to a second embodiment of the present invention.

FIG. 9A is a diagram showing a relationship of the data voltage Vdata and the voltage Vds_3 between the drain, and the source of the light emission control transistor M5 to the data current Idata as a potential difference ΔV to the analog ground voltage VSSA in the pixel drive circuit of the display pixel Px2 according to the second embodiment.

Figure 9B:
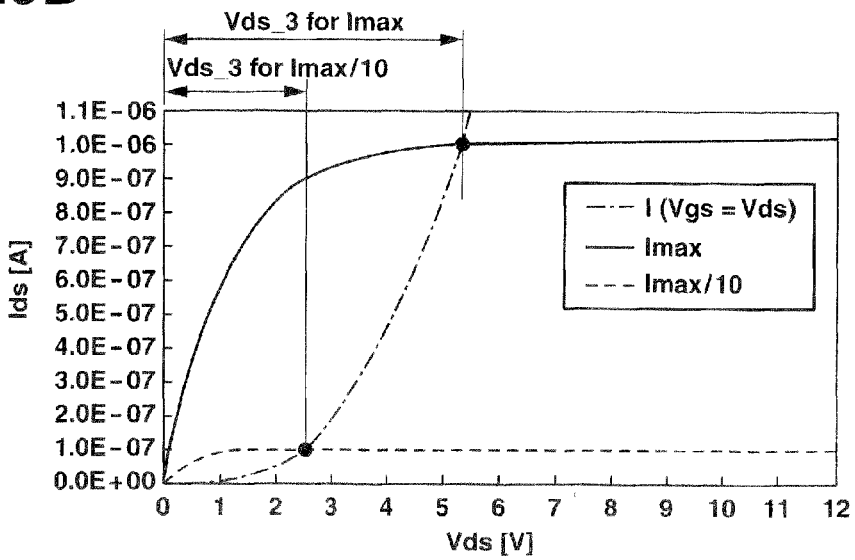
FIG. 9B is a diagram showing actually measured examples of a Vgs=Vds_3 curve of a light emission control transistor M5 written on Vd-Id curves of the light emission control transistor in the cases where the maximum light emission currents are 1 μA and the 1/10 thereof (100 nA) according to a second embodiment of the present invention.

FIG. 9B is a diagram actually measured examples of a Vgs=Vds_3 curve (expressed by an alternate long and short dash line) of a light emission control transistor M5 written on Vd-Id curves (expressed by a solid line and a broken line) of the light emission control transistor in the cases where the maximum light emission currents are 1 μA and the 1/10 thereof (100 nA) in the pixel drive circuit of the display pixel Px2 according to a second embodiment.

In FIG. 9A, if the maximum current value Imax at the time of a high brightness display is set to 1.0 μA and the maximum current value at the time of a low brightness display is set to 0.1 μA (=Imax/10: 100 nA), then the data voltage Vdata at the time of the maximum current value Imax of the high brightness display, that is, the data driver drive power source voltage VEE_H, is about −6 V, and the data voltage Vdata at the time of the maximum current value Imax/10 of the low brightness display, that is, the data driver drive power source voltage VEE_L, is about −2 V. If it is supposed that the threshold voltage Vth of a transistor changes up to about 4.0 V owing to an aged deterioration here, then it is necessary to set the data driver drive power source voltage VEE_H for the high brightness display at the time of the maximum current value Imax of the high, brightness display to −6 V+(−4 V)=−1.0 V or less. Moreover, it is only necessary to set the data driver drive power source voltage VEE_L for the low brightness display at the time of the maximum current value Imax/10 of the low brightness display to −2 V+(−4 V)=−6 V or less.

Furthermore, similarly as for the gate no-selection voltage VGL, it is necessary to consider the change of the threshold value Vth up to 4 V. Then, it is also necessary to set the gate non-selection voltage VGL_H for the high brightness display at the time of the maximum current value Imax of the high brightness display to a voltage lower than −10 V, and it is only necessary to set the gate non-selection voltage VGL_L for the low brightness display at the time of the maximum current value Imax/10 of the low brightness display to a voltage lower than −6 V.

In FIG. 9B, the intersection points of the respective two curves of a Vgs=Vds_3 curve (alternate long and short dash line) of the light emission control transistor M5 and Vd-Id curves (solid line and broken line) of the light emission control transistor M5 are the operation points at the time of the writing operations of the light emission control transistor M5.

As described above, it is also possible to perform a current control operation by changing the data driver drive power source voltage VEE and the gate non-selection voltage VGL as the change of the maximum brightness owing to the dimmer processing. Accordingly, it is only necessary to set the data driver drive power source voltage VEE_H and the gate non-selection voltage VGL_H for the high brightness display by the power source circuit A 42*b* to, for example, −12 V, which is less than −10 V (and −10 V−ΔV), and to set the data driver drive power source voltage VEE_L and the gate non-selection voltage VGL_L for the low brightness display by the power source circuit B 44*b* to, for example, −7.5 V, which is less than −6 V (and −6 V−ΔV).

Hereby, it is possible to suppress the power consumption depending on the bias current flowing through the operational amplifier at the output stage of the data driver 24*b*, and to suppress the power consumption caused by the charge and the discharge of the gate electrode of the light emission control transistor M5 at the same time.

Figure 10:
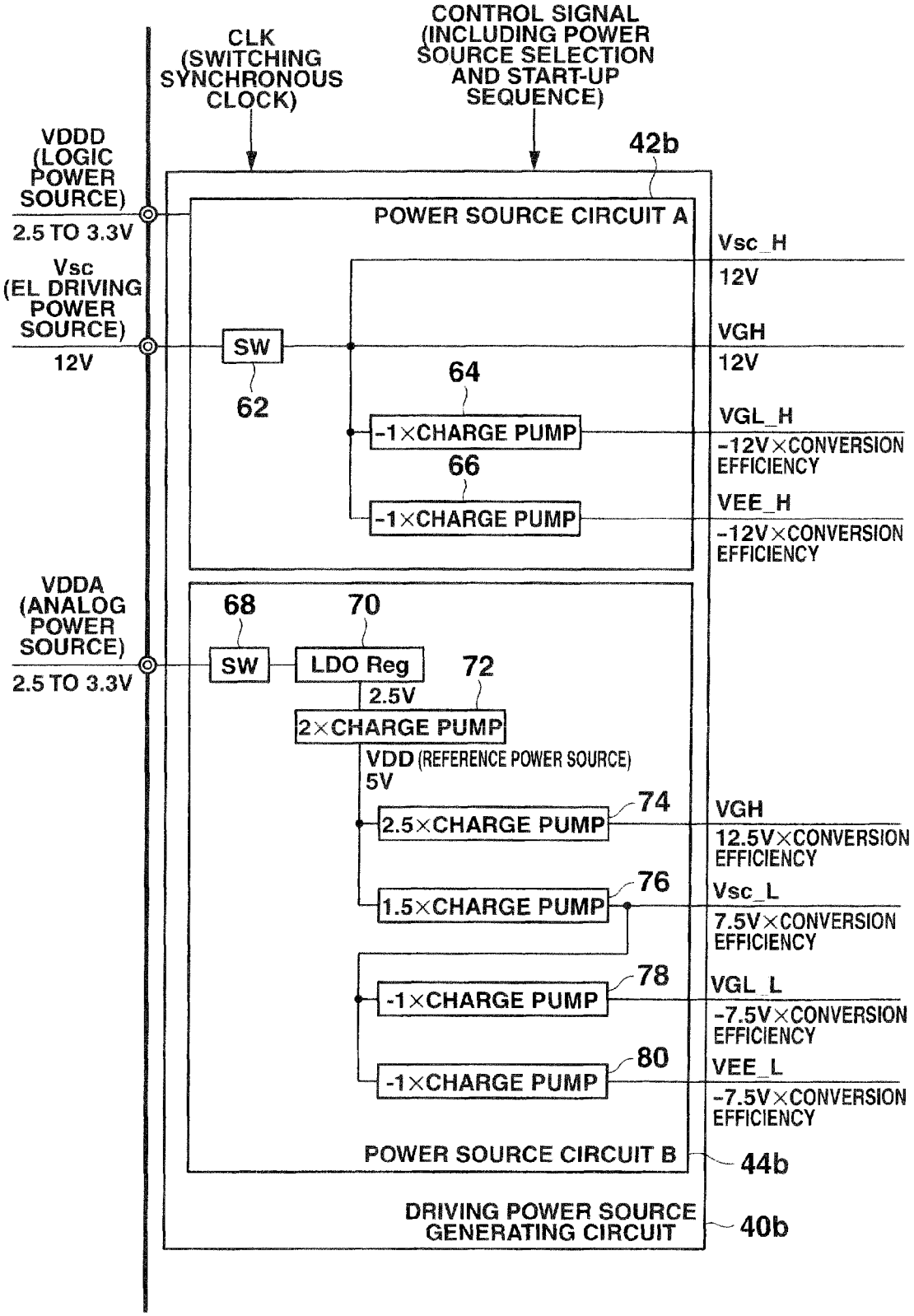
FIG. 10 is a diagram showing the concrete configuration examples of two power source circuits of a drive power source generating circuit according to a second embodiment of the present invention.

FIG. 10 is a diagram showing the concrete configuration examples of the power source circuit A 42*b* of the drive power source generating circuit 40*b* according to the second embodiment.

In FIG. 10, the power source circuit A 42*b* generates the aforesaid light emission drive voltage Vsc_H of 12 V, the data driver drive power source voltage VEE_H of −12 V, and the gate non-selection voltage VGL_H for the high brightness display, and the power source circuit B 44*b* generates the aforesaid light emission drive voltage Vsc_L of 7.5 V, the data driver drive power source voltage VEE_L of −7.5 V, and the gate non-selection voltage VGL_L for the low brightness display. These are the examples of using step-up type switching power sources by capacitor-based charge pump converters (charge pump circuits).

That is, the power source circuit A 42*b* includes a switch (hereinafter simply referred to as SW) 62 and charge pump circuits 64 and 66 of −1 time. The SW 62 switches the analog power source Vsc supplied from the outside between the transmission thereof to the subsequent stage and the un-transmission thereof to the subsequent stage according to the selection by a control signal from the logic circuit 38*b*. Incidentally, the switching timing thereof is further accurately adjusted in synchronization with a switching synchronization clock CLK given from the TG 36*b*. The charge pump circuits 64 and 66 of −1 time boost the analog power source Vsc supplied through the SW 62 by −1 time.

For example, the analog power source Vsc is an EL drive power source of 12 V generated by a not shown power source circuit of the equipment in which the display module 10*b* is incorporated. Accordingly, the power source circuit A 42*b* outputs the voltage 12 V as it is as the gate selection voltage VGH and the light emission drive voltage Vsc_H. Moreover, the power source circuit A 42*b* boosts the voltage 12 V by −1 time with the charge pump circuit 64 of −1 time and outputs the boosted voltage as the gate non-selection voltage VGL_H of −12 V (actually the loss for the conversion efficiency thereof exists). The power source circuit A 42*b* also boosts the voltage 12 V by −1 time with the charge pump circuit 66 of −1 time and outputs the boosted voltage as the data driver drive power source voltage VEE_H of −12 V (actually the loss for the conversion efficiency thereof exists).

Moreover, the power source circuit B 44*b* includes a SW 68, a low drop-out regulator (hereinafter referred to as LDO regulator) 70, a charge pump circuit 72 of 2 times, a charge pump circuit 74 of 2.5 times, a charge pump circuit 76 of 1.5 times, and charge pump circuits 78 and 80 of −1 time. The SW 68 switches the analog power source VDDA supplied from the outside between the transmission thereof to the subsequent stage and the un-transmission thereof to the subsequent stage according to the selection by a control signal from the logic circuit 38*b*. Incidentally, the switching timing is further accurately adjusted in synchronization with the switching synchronization clock CLK given from the TG 36*b*. The LDO regulator 70 regulates an input voltage within a predetermined voltage range to a constant analog voltage and outputs the regulated voltage. The LDO regulator 70 regulates the analog power source voltage VDDA supplied through the SW 68 to a predetermined constant analog voltage to output the regulated analog voltage. The charge pump circuit 72 of 2 times boosts the predetermined analog voltage output from the LDO regulator 70 by 2 times. The charge pump circuit 74 of 2.5 times boosts the analog voltage boosted by the charge pump circuit 72 of 2 times by 2.5 times. The charge pump circuit 76 of 1.5 times boosts the analog voltages boosted by the charge pump circuit 72 of 2 times by 1.5 time. The charge pump circuits 78 and 80 of −1 time boost the analog voltage boosted by the charge pump circuit 76 of 1.5 times by −1 time.

As the analog power source voltage VDDA, for example, a logic voltage that is used by the equipment in which the display module 10*b* is incorporated is utilized. Consequently, the voltage value varies depending on the equipment in which the display module 10*b* is incorporated, and, for example, a voltage within a range of about from 2.5 V to about 3.3 V is supplied. Accordingly, the power source circuit B 44*b* regulates the voltage of from 2.5 V to 3.3 V with the LDO regulator 70 to obtain a constant analog voltage of 2.5 V. Then, the power source circuit B 44*b* boosts the analog voltage of 2.5 V by 2 times with the charge pump circuit 72 of 2 times to obtain the reference power source VDD of 5 V (actually the loss for the conversion efficiency thereof exists). The power source circuit B 44*b* also boosts the reference power source VDD by 2.5 times with the charge pump circuit 74 of 2.5 times and outputs the boosted reference power source VDD as the gate selection voltage VGH of 12.5 V (actually the loss for the conversion efficiency thereof exists). Moreover, the power source circuit B 44*b* boosts the reference power source VDD by 1.5 times with the charge pump circuit 76 of 1.5 times and outputs the boosted reference power source VDD as the light emission drive voltage Vsc_L of 7.5 V (actually the loss for the conversion efficiency thereof exists). Furthermore, the power source circuit B 44*b* boosts the analog voltage, obtained by boosting reference power source VDD by 1.5 times with the charge pump circuit 76 of 1.5 times to be 7.5 V (actually the loss for the conversion efficiency thereof exists), by −1 time with the charge pumps circuit 78 of −1 time and outputs the boosted analog voltage as the gate non-selection voltage VGL_L of −12.5 V (actually the loss for the conversion efficiency thereof exists). The power source circuit B 44*b* similarly boosts the analog voltage by −1 time with the charge pump circuit 80 of −1 time and outputs the boosted analog voltage as the data driver drive power source voltage VEE_L of −7.5 V (actually the loss for the conversion efficiency thereof exists).

Incidentally, the configuration of the power source circuits are not limited to those ones described above, but any configurations may be used as long as the configurations are the power sources capable of being incorporated in the display module 10*b*, such as a step-up type switching power source using an inductor based boost converter.

According to the second embodiment described above, in the active matrix display module subjected to the dimmer processing of the large dynamic range at the maximum brightness, the light emission drive voltage at a time of the low brightness display is controlled to be lower than the light emission drive voltage at a time of the high brightness display, and the absolute value of the gate non-selection voltage at a time of the low brightness display is controlled to be smaller than the absolute value of the gate non-selection voltage at a time of the high brightness display. The display module includes two power source circuits including a power source circuit designed to generate a light emission drive voltage and the gate non-selection voltage for the low brightness display with high efficiency and a power source circuit designed to generate a light emission drive voltage and the gate non-selection voltage for the high brightness display with high efficiency. The display module is configured so that the power source circuit, an efficiency of which is most appropriate, is selected at a time of the low brightness display and at a time of the high brightness display. Thereby, the present embodiment makes it possible to cope with both of a high brightness display and low power consumption at a time of the low brightness display.

Although the present invention has been described on the basis of each of the embodiments in the above, the present invention is not limited to the embodiments described above, but it is needless to say that various modulations and applications can be performed without departing from the spirit and scope of the present invention.

For example, although the first embodiment described above sets the display mode to have the two stages of the high brightness display and the low brightness display and is provided with two kinds of power source to switch the light emission drive voltage to the two stages severally according to the high brightness display and the low brightness display, the display mode may be set to have three or more stages, and three kinds or more power source circuits may be provided accordingly to the display mode to be switched according to the display mode.

Moreover, although all of the three voltages of the light emission drive voltage Vsc, the data driver drive power source voltage VEE, and the gate non-selection voltage VGL are switched in two stages severally in the second embodiment, the configuration of switching at least one of the voltages may be adopted, and the advantage of suppressing the power consumption can be expected even in that case.

Moreover, although two transistors of the selection transistor M1 and the drive transistor M2 are applied in the pixel drive circuit of the display pixel Px1 in the first embodiment, and three transistors of the drive control transistor M3, writing control transistor M4 and the light emission control transistor M5 are applied in the pixel drive circuit of the display pixel Px2 in the second embodiment, the present invention is not limited to the embodiments and may be configured to be a pixel drive circuit including four or more transistors.

Moreover, although the case of a voltage control method for supplying drive voltage having voltage value according to the display data from the data driver 24*b* to the display pixel Px2 to drive the display pixel Px2 is explained in the second embodiment, a current control method for supplying drive current having current value according to display data to each of the display pixel Px2 may be applied, and the present invention can be equally applied.

The entire disclosure of Japanese Patent Application No. 2008-087933 filed on Mar. 28, 2008 and No. 2008-088680 filed on Mar. 28, 2008 including description, claims, drawings, and abstract are incorporated herein by reference in its entirety.

Although various exemplary embodiments have been shown and described, the invention is not limited to the embodiments shown. Therefore, the scope of the invention is intended to be limited solely by the scope of the claims that follow.

What is claimed is:

1. A display apparatus for displaying image information according to display data, the apparatus comprising:

display pixels, each having a light emitting element; and a drive circuit for making each of the light emitting elements emit a light having brightness according to the display data, and including a plurality of power source circuits and a selecting circuit, wherein each of the plurality of power source circuits generates a first voltage used as a light emission drive voltage to be supplied to the display pixels to flow a drive current according to the display data to each of the light emitting elements and generates voltages of different values, respectively, as the first voltage; and the selecting circuit selects any one of the plurality of power source circuits according to a display state set to the display pixels and causes the selected power source circuit to generate the first voltage.

2. The display apparatus according to claim 1, wherein the display state includes a plurality of display modes in which each maximum brightness value set to each of the light emitting elements of the display pixels, when the display data is maximum gradation, are different from each other, and each of the first voltages generated by the plurality of power source circuits, respectively, is set to a voltage value enabling the light emitting element to emit a light at the maximum brightness in each of the plurality of display modes.

3. The display apparatus according to claim 2, wherein the display apparatus is switched to be set to any one of the plurality of display modes based on an usage state of the display apparatus, and the selecting circuit switches the selected power source circuit according to switching of the display mode.

4. The display apparatus according to claim 2, wherein the plurality of display modes includes:

a first display mode, in which the maximum brightness is set to a first brightness; and a second display mode, in which the maximum brightness is set to a second brightness lower than the first brightness;

the plurality of power source circuits include:

a first power source circuit for generating the first voltage having a first voltage value which enables the light emitting element to be set to the first brightness based on a first externally supplied voltage; and a second power source circuit for generating the first voltage having a second voltage value which enables the light emitting element to be set to the second brightness based on a second externally supplied voltage lower than the first externally supplied voltage; and the selecting circuit selects the first power source circuit and prevent the second power source circuit from generating the first voltage when the display state is set to the first display mode, and selects the second power source circuit and prevent the first power source circuit from generating the first voltage when the display state is set to the second display mode.

5. The display apparatus according to claim 4, wherein the selecting circuit intercepts a voltage supply of the second externally supplied voltage to the second power source circuit to prevent the second power source circuit from generating the first voltage when selecting the first power source circuit, and intercepts a voltage supply of the first externally supplied voltage to the first power source circuit to prevent the first power source circuit from generating the first voltage when selecting the second power source circuit.

6. The display apparatus according to claim 1, further comprising:

a plurality of selection lines arranged in row directions;

a plurality of data lines arranged in column directions;

a plurality of power source lines arranged in row directions; and a display area including the plurality of display pixels arranged in two dimensions in the neighborhood of each intersection point of each of the data lines and each of the selection lines, and each of the data lines and each of the power source lines;

wherein the drive circuit includes a power source drive circuit for applying the light emission drive voltage to each of the power source lines by being supplied with the first voltage generated in the selected power source circuit.

7. The display apparatus according to claim 6, wherein each of the display pixels includes at least the light emitting element and a drive transistor for supplying drive current according to the display data through a current path to the light emitting element, wherein one end of the current path is connected to one end of the light emitting element and any one of the other end of the current path or the other end of the light emitting element is connected to the power source line.

8. The display apparatus according to claim 1, wherein the display state corresponds to a maximum value of a light emitting brightness set to each of the light emitting elements of each of the display pixels according to the display data, and the selecting circuit switches the selected power source circuit according to the maximum value of the light emitting brightness.

9. A display apparatus for displaying image information corresponding to display data, the apparatus comprising:

display pixels, each having a light emitting element; and a drive circuit for making each of the light emitting elements emit a light having brightness according to the display data, and including a plurality of power source circuits and a selecting circuit, wherein each of the plurality of power source circuits generates a first voltage used as a light emission drive voltage to be supplied to the display pixels to flow a drive current according to the display data to each of the light emitting elements and a second voltage to set a signal level of a control signal to perform drive control of each of the display pixels and generates voltages of different values as the first voltage and different values as the second voltage, respectively; and the selecting circuit selects any one of the plurality of power source circuits according to a display state set to the display pixels and causes the selected power source circuit to generate the first voltage and the second voltage.

10. The display apparatus according to claim 9, wherein the display state includes a plurality of display modes in which maximum brightness set to the light emitting element is different from each other when the display data is maximum gradation, and each of the first voltages and the second voltages generated by each of the plurality of power source circuits is set to a voltage value necessary for making the light emitting element emit a light at the maximum brightness in each of the plurality of display modes.

11. The display apparatus according to claim 10, wherein the plurality of display modes includes:

a first display mode, in which the maximum brightness is set to a first brightness; and a second display mode, in which the maximum brightness is set to a second brightness lower than the first brightness;

the plurality of power source circuits include:

a first power source circuit for generating the first voltage having a first voltage value which enables the light emitting element to be set to the first brightness and the second voltage having a third voltage value based on a first externally supplied voltage; and a second power source circuit for generating the first voltage having second voltage value which enables the light emitting element to be set to the second brightness and the second voltage having a fourth voltage value based on a second externally supplied voltage lower than the first externally supplied voltage; and the selecting circuit selects the first power source circuit and prevent the second power source circuit from generating the first voltage when the display state is set to the first display mode, and selects the second power source circuit and prevent the first power source circuit from generating the first voltage when the display state is set to the second display mode.

12. The display apparatus according to claim 11, wherein the selecting circuit intercepts a voltage supply of the second externally supplied voltage to the second power source circuit to prevent the second power source circuit from generating the first voltage and the second voltage when selecting the first power source circuit, and intercepts a voltage supply of the first externally supplied voltage to the first power source circuit to prevent the first power source circuit from generating the first voltage and the second voltage when selecting the second power source circuit.

13. The display apparatus according to claim 9, further comprising:

a plurality of selection lines arranged in row directions;

a plurality of data lines arranged in column directions;

a plurality of power source lines arranged in row directions; and a display area including the plurality of display pixels arranged in two dimensions in the neighborhood of each intersection point of each of the data lines and each of the selection lines, and each of the data lines and each of the power source lines;

wherein the drive circuit includes:

scan drive circuit for applying selection signal to the selection lines to set the display pixels to be connected to the selection lines to be a selected state;

a data drive circuit for applying drive signal to each of the data lines, the drive signal is for making the light emitting element of each of the display pixels emit a light according to the display data;

a power source drive circuit for applying the light emission drive voltage to each of the power source lines, wherein the first voltage is supplied to the power source drive circuit to be used as the light emission drive voltage, and the second voltage includes at least a voltage to be applied to the scan drive circuit and used for setting a high-level voltage and a low-level voltage of the selection signal.

14. The display apparatus according to claim 13, wherein the second voltage further includes a voltage to be applied to the data drive circuit to be used for setting a high-level voltage and a low-level voltage of the drive signal.

15. The display apparatus according to claim 13, wherein each of the display pixels includes:

the light emitting element;

a light emission control transistor, one end of a current path thereof is connected to one end of the light emitting element and the other end of the current path thereof is connected to the power source line;

a drive control transistor, a control terminal thereof is connected to the selection line, one end of a current path thereof is connected to the light emission control transistor and the other end of the current path thereof is connected to the power source line;

a writing control transistor, a control terminal thereof is connected to the selection line, one end of a current path thereof is connected to the data line and the other end of the current path thereof is connected to the other end of the current path of the light emission control transistor and one end of the light emitting element; and a holding capacitor arranged between the control terminal of the drive control transistor and one end of the current path.

16. The display apparatus according to claim 9, wherein the display state corresponds to a maximum value of a light emission brightness set to each of the light emitting element of each of the display pixels according to the display data, and the selecting circuit switches the selected power source circuit according to the maximum value of the light emission brightness.

17. A drive method of a display apparatus for displaying image information according to display data by display pixels, each having a light emitting element, wherein the display apparatus comprising a plurality of power source circuits, each generating a first voltage used as a light emission drive voltage to be supplied to the display pixels and respectively generating voltages of different values as the first voltage; and the drive method comprises the steps of:

selecting any one of the plurality of power source circuits according to a display state set to the plurality of display pixels;

causing the selected power source circuit to generate the first voltage; and causing the other power source circuit not to generate the first voltage.

18. The drive method of a display apparatus according to claim 17, wherein the plurality of display states include:

a first display mode, in which a maximum brightness value to be set to the light emitting element is set to a first brightness when the display data is maximum gradation, and a second display mode, in which a maximum brightness value to be set to the light emitting element is set to a second brightness lower than the first brightness when the display data is maximum gradation;

the plurality of power source circuits include:

a first power source circuit for generating the first voltage having first voltage value enabling the light emitting element to be set to the first brightness according to a first external supplied voltage, and a second power source circuit for generating the first voltage having second voltage value enabling the light emitting element to be set to the second brightness according to a second external supplied voltage lower than the first externally supplied voltage;

the selecting step is a step for selecting the first power source circuit when the display state is set to the first display mode, or a step for selecting the second power source circuit when the display state is set to the second display mode; and the stopping step is a step for not selecting the second power source circuit and preventing the second power source circuit from generating the first voltage when the display state is set to the first display mode, or a step for not selecting the first power source circuit and preventing the first power source circuit from generating the first voltage when the display state is set to the second display mode.

19. A drive method of a display apparatus for displaying image information according to display data by display pixels, each having a light emitting element, wherein the display apparatus comprising a plurality of power source circuits, each generating a first voltage used as a light emission drive voltage to be supplied to each of the display pixels and a second voltage used for setting signal level of a control signal for drive controlling the display pixels and respectively generating voltages of different values as the first voltage and the second voltage; and the drive method comprises the steps of:

selecting any one of the plurality of power source circuits according to a display state set to the plurality of display pixels;

causing the selected power source circuit to generate the first voltage and the second voltage; and causing the other power source circuit not to generate the first voltage and the second voltage.

20. The drive method of a display apparatus according to claim 19, wherein the plurality of display states include:

a first display mode, in which a maximum brightness value to be set to the light emitting element is set to a first brightness when the display data is maximum gradation, and a second display mode, in which a maximum brightness value to be set to the light emitting element is set to a second brightness lower than the first brightness when the display data is maximum gradation;

the plurality of power source circuits include:

a first power source circuit for generating the first voltage having first voltage value enabling the light emitting element to be set to the first brightness and the second, voltage having third voltage value according to a first externally supplied voltage, and a second power source circuit for generating the first voltage having second voltage value enabling the light emitting element to be set to the second brightness and the second voltage having fourth voltage value according to a second externally supplied voltage lower than the first externally supplied voltage;

the selecting step is a step for selecting the first power source circuit when the display state is set to the first display mode, or a step for selecting the second power source circuit when the display state is set to the second display mode; and the stopping step is a step for not selecting the second power source circuit and preventing the second power source circuit from generating the first voltage; and the second voltage when the display state is set to the first display mode, or a step for not selecting the first power source circuit and preventing the first power source circuit from generating the first voltage and the second voltage when the display state is set to the second display mode.

* * * * *